US011728562B2

(12) United States Patent
Sung et al.

(10) Patent No.: US 11,728,562 B2
(45) Date of Patent: Aug. 15, 2023

(54) WIRELESS ELECTRONIC DEVICE WITH ANTENNA STRUCTURES IN MULTIPLE LAYERS

(71) Applicants: SAMSUNG DISPLAY CO., LTD., Yongin-si (KR); ULSAN NATIONAL INSTITUTE OF SCIENCE AND TECHNOLOGY, Ulsan (KR)

(72) Inventors: Eunjin Sung, Yongin-si (KR); Thi Duyen Nguyen, Ulsan (KR); Jae-Kyoung Kim, Hwaseong-si (KR); Wonsang Park, Yongin-si (KR); Gangil Byun, Ulsan (KR); Seongryong Lee, Hwaseong-si (KR); Jinmyeong Heo, Suwon-si (KR)

(73) Assignees: SAMSUNG DISPLAY CO., LTD., Yongin-si (KR); ULSAN NATIONAL INSTITUTE OF SCIENCE AND TECHNOLOGY, Ulsan (KR)

( * ) Notice: Subject to any disclaimer, the term of this patent is extended or adjusted under 35 U.S.C. 154(b) by 64 days.

(21) Appl. No.: 17/173,496

(22) Filed: Feb. 11, 2021

(65) Prior Publication Data

US 2021/0328328 A1 Oct. 21, 2021

(30) Foreign Application Priority Data

Apr. 21, 2020 (KR) ..... 10-2020-0048319

(51) Int. Cl.
*H01Q 1/24* (2006.01)
*H01Q 1/36* (2006.01)
(Continued)

(52) U.S. Cl.
CPC ..... *H01Q 1/243* (2013.01); *H01Q 1/36* (2013.01); *H01Q 1/48* (2013.01); *H01Q 9/16* (2013.01)

(58) Field of Classification Search
CPC ..... H01Q 1/24; H01Q 1/243; H01Q 1/36; H01Q 1/38; H01Q 1/44; H01Q 9/285;
(Continued)

(56) References Cited

U.S. PATENT DOCUMENTS 10,374,295 B2 8/2019 Kim et al.
10,381,750 B2 8/2019 Jung et al.
(Continued)

FOREIGN PATENT DOCUMENTS

EP 3098699 11/2016
EP 30986699 11/2016
(Continued)

OTHER PUBLICATIONS

Kan, et al., "Simple Broadband Planar CPW-Fed Quasi-Yaga Antenna", IEEE Antennas and Wireless Propagation Letters, vol. 6, 2007, pp. 18-20.

(Continued)

*Primary Examiner* — Thai Pham
(74) *Attorney, Agent, or Firm* — F. Chau & Associates, LLC

(57) ABSTRACT

An electronic device includes a display panel including a display area and a non-display area. The electronic device includes an input sensor disposed on the display panel and including a plurality of bridge elements and a plurality of sensing patterns connected to the plurality of bridge elements, and an antenna disposed on the same layer as the input sensor. The antenna includes a first sub-antenna disposed on a same layer as the bridge element and including a first portion extending in a first direction and a second portion extending from one end of the first portion in a second direction crossing the first direction and a second sub-antenna disposed on a same layer as the sensing pattern and including a third portion and a fourth portion extending
(Continued)

from one end of the third portion in a direction opposite to the second direction.

23 Claims, 19 Drawing Sheets

(51) Int. Cl.
*H01Q 1/48* (2006.01)
*H01Q 9/16* (2006.01)

(58) Field of Classification Search
CPC .... G06F 1/1624; G06F 1/1643; G06F 3/0443; G06F 3/0445; G06F 3/0446; G06F 3/0412; G06F 2203/04112
See application file for complete search history.

(56) References Cited

U.S. PATENT DOCUMENTS

| | | | |
|---|---|---|---|
| 2011/0090131 | A1 | 4/2011 | Chen et al. |
| 2016/0190678 | A1 | 6/2016 | Hong et al. |
| 2017/0139520 | A1 | 5/2017 | Yeh et al. |
| 2018/0034130 | A1 | 2/2018 | Jang |
| 2020/0067176 | A1 | 2/2020 | Kim et al. |
| 2020/0227819 | A1 | 7/2020 | Oh et al. |
| 2021/0132736 | A1* | 5/2021 | Kim ..... H01Q 1/22 |
| 2021/0358996 | A1* | 11/2021 | Lee ..... H01Q 19/005 |

FOREIGN PATENT DOCUMENTS

| | | |
|---|---|---|
| EP | 3147763 | 3/2017 |
| KR | 10-2016-0080444 | 7/2016 |
| KR | 10-2017-0119849 | 10/2017 |
| KR | 10-2018-0014296 | 2/2018 |
| KR | 10-2019-0019802 | 2/2019 |
| KR | 10-2019-0069226 | 6/2019 |
| WO | 2020071679 | 4/2020 |

OTHER PUBLICATIONS

Fioc'h, et at, "On the Design of Planar Printed Dipole Array Antennas", Wireless Engineering and Technology, 2012, 3, 203-209.

European Search Report dated Aug. 25, 2021 in corresponding European Patent Application No. 21169436.9 (5 pages).

* cited by examiner

WIRELESS ELECTRONIC DEVICE WITH ANTENNA STRUCTURES IN MULTIPLE LAYERS

CROSS-REFERENCE TO RELATED APPLICATION

This U.S. non-provisional patent application claims priority under 35 U.S.C. § 119 of Korean Patent Application No. 10-2020-0048319, filed on Apr. 21, 2020, the contents of which are hereby incorporated by reference in its entirety.

FIELD OF DISCLOSURE

The present disclosure relates generally to wireless electronic devices with embedded antennas, and more particularly to a display device with an antenna embedded within a display area.

DISCUSSION OF THE RELATED ART

A wireless electronic device ("wireless device") includes circuitry arranged in electronic modules. For example, a wireless device can be a mobile terminal or a wearable device, and the electronic modules may include an antenna module, a camera module, a battery module, etc. With current trends of manufacturing thinner and smaller wireless devices, space available for the electronic modules is becoming gradually scarcer. In addition, as electronic devices become highly functional and are developed to meet stringent specifications, the number of electronic modules included in an electronic device is increasing.

Recently, attempts have been made to embed antennas that appear transparent within wireless display devices such as smartphones, which may free up space otherwise allocated for the antennas. Such antennas have a mesh structure with extremely thin wires to enable light representing images generated by a display panel to be projected to a viewer.

SUMMARY

The present disclosure provides an electronic device having an improved antenna efficiency by arranging a dipole antenna in a display area using a portion of an input sensor panel.

Embodiments of the inventive concept provide an electronic device including a display panel including a display area and a non-display area adjacent to the display area. The display area includes a first area and a second area between the first area and one side of the non-display area, an input sensor disposed on the display panel and including a plurality of bridge elements and a plurality of sensing patterns (sensing elements) connected to the plurality of bridge elements, and an antenna disposed on a same layer as the input sensor and overlapping the second area. The antenna includes a first sub-antenna disposed on a same layer as the bridge elements and including a first portion extending in a first direction and a second portion extending from one end of the first portion in a second direction crossing the first direction and a second sub-antenna disposed on a same layer as the sensing pattern and including a third portion overlapping the first portion and a fourth portion extending from one end of the third portion in a direction opposite the second direction.

In various embodiments:

The second portion and the fourth portion are arranged symmetrically to each other in the second direction.

One sub-antenna of the first sub-antenna and the second sub-antenna further includes a ground portion, and the ground portion is connected to one portion of the first portion and the third portion.

The ground portion extends to the non-display area.

The input sensor and the antenna further include a first insulating layer and a second insulating layer disposed on the first insulating layer, the first sub-antenna is disposed on the first insulating layer, and the second sub-antenna is disposed on the second insulating layer.

The first sub-antenna and the second sub-antenna have different electrical polarities from each other.

The first sub-antenna and the second sub-antenna each have a mesh structure.

The first portion has an area that is equal to an area of the third portion, and the second portion has an area that is equal to an area of the fourth portion.

The first portion of the first sub-antenna is disposed closer to the non-display area than the second portion is.

The input sensor includes a plurality of first sensing patterns arranged in the second direction crossing the first direction, a plurality of first bridge elements connecting the first sensing patterns adjacent to each other among the first sensing patterns, a plurality of second sensing patterns arranged in the first direction, and a plurality of second bridge elements connecting the second sensing patterns adjacent to each other among the second sensing patterns.

The first sensing patterns, the second sensing patterns, and the second bridge elements are disposed on the second insulating layer, and the first bridge elements are disposed on the first insulating layer.

The second sub-antenna is disposed between the first sensing patterns.

The display panel includes a base surface defined therein and including a thin film encapsulation layer, and the input sensor and the antenna are disposed directly on the base surface.

The antenna further includes at least one reflective pattern connected to at least one of the first sub-antenna and the second sub-antenna.

One sub-antenna of the first sub-antenna and the second sub-antenna further includes a ground portion connected to one portion of the first portion and the third portion, and the at least one reflective pattern extends in the second direction from at least one side of the ground portion.

Embodiments of the inventive concept provide an electronic device including a display panel including a display area and a non-display area adjacent to the display area. The display area includes a first area and a second area between the first area and one side of the non-display area, an input sensor disposed on the display panel and including a plurality of sensing patterns, a first antenna layer disposed on a same layer as the input sensor and overlapping the second area, and a second antenna layer disposed on the first antenna layer. A first sub-antenna is disposed on the first antenna layer and extends partially in a first direction partially in a second direction crossing the first direction, a second sub-antenna is disposed on the second antenna layer and extends partially in the first direction and partially in a direction opposite the second direction, and the first sub-antenna and the second sub-antenna have different electrical polarities.

In various embodiments:

The input sensor includes a bridge element and the sensing patterns disposed on a layer different from a layer on which the bridge element is disposed, the first antenna layer and the sensing patterns are disposed on a same layer, and the second antenna layer is disposed on a layer different from a layer on which the input sensor is disposed.

The sensing patterns include a plurality of first sensing patterns arranged in the second direction and a plurality of second sensing patterns arranged in the second direction.

The second sub-antenna is provided in plural, the second sub-antennas are arranged in the first direction, and each of the second sub-antennas is disposed between the first sensing patterns.

The electronic device further includes an insulating layer disposed between the first antenna layer and the second antenna layer, and the insulating layer includes an insulating material having a predetermined dielectric constant.

The first sub-antenna and the second sub-antenna each have a mesh structure.

One sub-antenna of the first sub-antenna and the second sub-antenna includes a ground portion and at least one reflective pattern extending in the second direction from at least one side of the ground portion.

According to the above, the electronic device includes the dipole antenna that is stacked on an edge of the display device with the input sensor. The dipole antenna is patterned in the area from which the sensing pattern of the input sensor is partially removed. Thus, a volume of the electronic device is reduced.

In another aspect, an electronic device includes: at least first and second insulating layers, the first insulating layer being disposed on the second insulating layer; a first sub-antenna disposed within the first insulating layer; and a second sub-antenna disposed within the second insulating layer. The first sub-antenna is a first arm of a dipole, the first arm having a first stem portion and a folded portion perpendicular to the first stem portion and extending from the first stem portion in a first direction. The second sub-antenna is a second arm of the dipole, the second arm having a second stem portion parallel to the first stem portion and having a folded portion perpendicular to the second stem portion and extending in a direction opposite the first direction.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
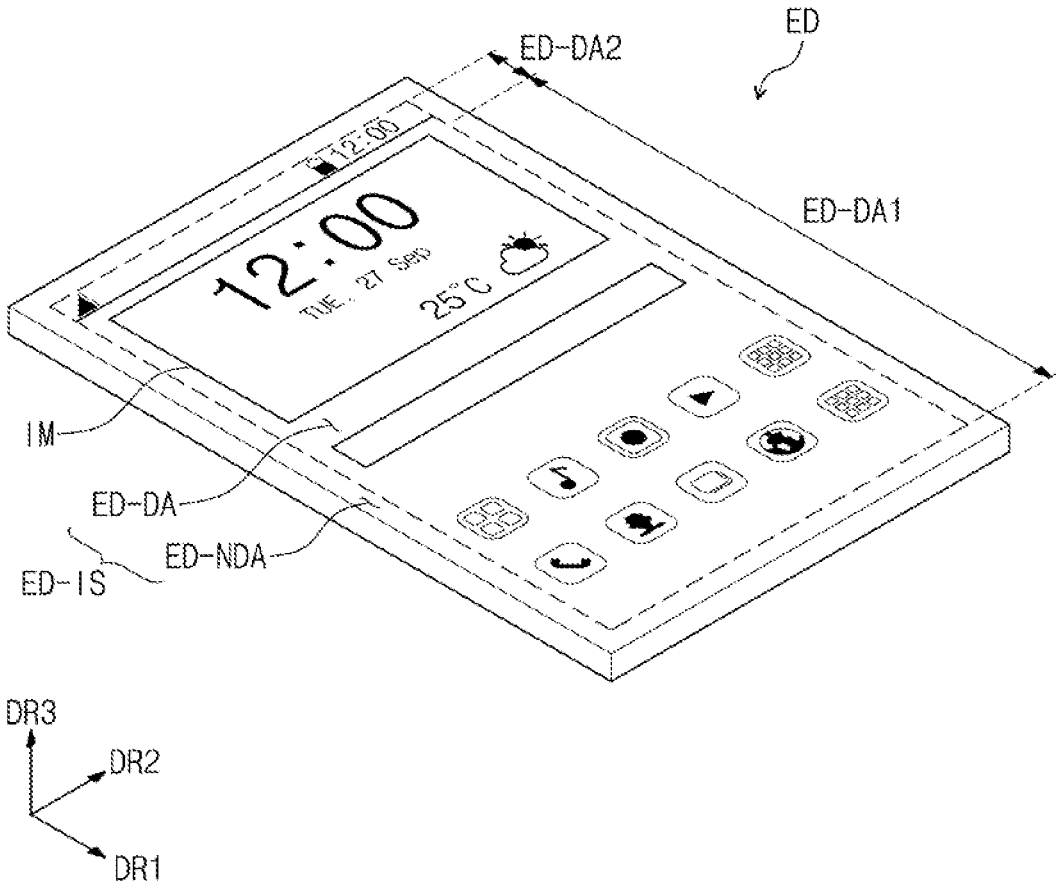
FIG. 1 is a perspective view showing an electronic device according to an embodiment of the present disclosure.

In the present disclosure, it will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness, ratio, and dimension of components are exaggerated for effective description of the technical content. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as shown in the figures.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present disclosure will be described with reference to accompanying drawings.

FIG. 1 is a perspective view showing an electronic device ED according to an embodiment of the present disclosure. The electronic device ED may be a display device that displays an image IM through a display surface ED-IS. The display device may be a touch screen display device configured in a stacked layer structure, with a display panel at a lower layer and a transparent input sensor (e.g., a touch input sensor) above the display panel, where images are projected through the input sensor. The display surface ED-IS is substantially parallel to a plane defined by a first directional axis DR1 and a second directional axis DR2. A third directional axis DR3 indicates a normal line direction of the display surface ED-IS, i.e., a thickness direction of the electronic device ED.

A user is able to select icons and the like within the image IM via touch input on the touch screen, which is sensed by the image sensor. The display surface ED-IS includes a display area ED-DA through which the image IM is displayed and a non-display area ED-NDA defined adjacent to the display area ED-DA. The non-display area ED-NDA through which the image IM is not displayed corresponds to a bezel area. The display area ED-DA may include a first area ED-DA1 and a second area ED-DA2. As shown in FIG. 1, the second area ED-DA2 is disposed between the first area ED-DA1 and one side of the non-display area ED-NDA. (The second area ED-DA2 is adjacent to at least one of the top, bottom, left and right sides of the non-display area ED-NDA.) The second area ED-DA2 may be an area of the image IM displaying widgets or the like, which a user is less likely to touch to initiate an input command.

As will be described in detail below, at least one antenna may be embedded within the second area ED-DA2. The antenna (e.g., "AN", FIGS. 5A-7) may have a mesh structure with extremely thin conductors, similar to those of the input sensor IS, so that it's transparent to the image projected therethrough from the display panel DP in a layer underneath the antenna AN. At least a portion of the antenna AN may be disposed within the same layer occupied by the input sensor IS. The antenna AN may be a dipole antenna AN having a first arm ("sub-antenna") in a first layer of the electronic device ED in the thickness direction (DR3 direction) and a second arm in a different layer of the electronic device ED. The configuration of the dipole antenna may result in improved performance in terms of antenna efficiency and/or radiation pattern characteristics. In some embodiments, input sensors IS are removed in the second area ED-DA2 to make room for the antenna AN, so that input sensing is disabled in the second area ED-DA2 (e.g., embodiments of FIGS. 5A-7). In other embodiments, input sensing is only partially disabled in the second area ED-DA2 (e.g., embodiments of FIGS. 9-11).

Front (or upper) and rear (or lower) surfaces of each member or each unit described below are distinguished from each other by the third directional axis DR3. However, the first, second, and third directional axes DR1, DR2, and DR3 are merely exemplary. Hereinafter, first, second, and third directions respectively correspond to directions indicated by the first, second, and third directional axes DR1, DR2, and DR3 and are assigned with the same reference numerals as the first, second, and third directional axes DR1, DR2, and DR3.

In the illustrated embodiment of the present disclosure, the electronic device ED includes a flat display surface. In other embodiments, the electronic device ED includes a curved display surface or a three-dimensional display surface. The three-dimensional display surface may include a plurality of display areas facing different directions from each other. For example, the three-dimensional display surface may have a polygonal column-shaped display surface.

The electronic device ED may be a rigid display device or a flexible electronic device ED. In the shown embodiments, the electronic device ED that may be applied to a mobile terminal is shown as a representative example. Although not shown in figures, electronic modules, a camera module, and a power module, which are mounted on a main board, may be placed on a bracket/a case with the electronic device ED to form the mobile terminal. The electronic device ED according to the present disclosure may be applied to a large-sized electronic item, such as a television set or a monitor, and a small and medium-sized electronic item, such as a tablet computer, a car navigation unit, a game unit, and a smart watch.

FIG. 1 shows icon images as a representative example of the image IM. As shown in FIG. 1, the display area ED-DA may have a substantially quadrangular shape. The non-display area ED-NDA may surround the display area ED-DA, as illustrated. In other embodiments, the non-display area is located asymmetrically with respect to the display area (e.g., it is located in only one or two edge areas).

FIGS. 2A to 2D are cross-sectional views showing an electronic device ED according to an embodiment of the present disclosure. FIGS. 2A to 2D show cross-sections defined by the second directional axis DR2 and the third directional axis DR3. In FIGS. 2A to 2D, components of the electronic device ED are schematically shown to explain a stacking relationship of a functional panel and/or functional units that form the electronic device ED.

The electronic device ED according to the embodiment of the present disclosure may include a display panel DP, an input sensor IS, an anti-reflective unit, and a window. At least some components of the display panel DP, the input sensor IS, the anti-reflective unit, and the window may be formed through successive processes or may be attached to each other by an adhesive member. FIGS. 2A to 2D show an optically clear adhesive member OCA as a representative example of the adhesive member. The adhesive member described hereinafter may include a conventional adhesive or pressure sensitive adhesive. In the present embodiment of the present disclosure, the anti-reflective unit and the window may be replaced with other components or may be omitted.

In FIGS. 2A to 2D, among the input sensor IS, the anti-reflective unit, and the window, a component that is formed through the successive processes with another component is referred to as a "layer". Among the input sensor IS, the anti-reflective unit, and the window, a component that is coupled to another component by the adhesive member is referred to as a "panel". The panel includes a base layer providing a base surface, e.g., a synthetic resin film, a composite film, or a glass substrate, however, the base layer may be omitted from the component that is referred to as the "layer". In other words, the component that is referred to as the "layer" is disposed on the base surface provided by another component.

The input sensor IS, the anti-reflective unit, and the window may be referred to as an input sensing panel ISP, an anti-reflective panel RPP, and a window panel WP, respectively, or an input sensing layer ISL, an anti-reflective layer RPL, and a window layer WL, respectively, depending on a presence or absence of the base layer.

Figure 2A:
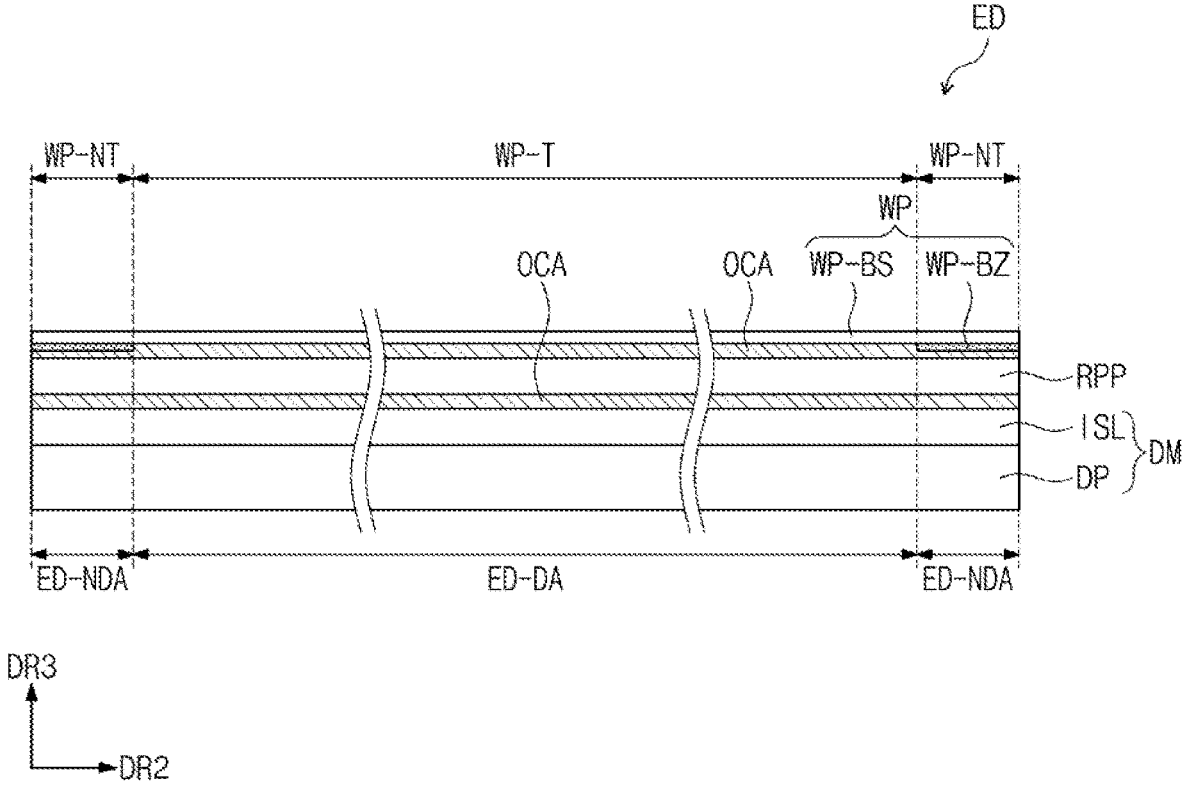
FIGS. 2A to 2D are cross-sectional views showing an electronic device according to an embodiment of the present disclosure.

Referring to FIG. 2A, the electronic device ED may include the display panel DP, the input sensing layer ISL, the anti-reflective panel RPP, and the window panel WP. The input sensing layer ISL is disposed directly on the display panel DP. In the present disclosure, the expression "component "B" is disposed directly on component "A"" means that no intervening elements, such as an adhesive layer/adhesive member, are present between the component "B" and the component "A". The component "B" is formed on a base surface provided by the component "A" through successive processes after the component "A" is formed.

The display panel DP and the input sensing layer ISL disposed directly on the display panel DP are defined as a display module DM. The optically clear adhesive member OCA is disposed between the display module DM and the anti-reflective panel RPP and between the anti-reflective panel RPP and the window panel WP.

The display panel DP generates the image IM, and the input sensing layer ISL obtains coordinate information of an external input (e.g., touch event). Although not shown separately, the display module DM according to the embodiment of the present disclosure may further include a protective member disposed on a lower surface of the display panel DP. The protective member and the display panel DP are coupled to each other by the adhesive member. The electronic devices ED described below with reference to FIGS. 2B to 2D may also further include the protective member.

The display panel DP according to the embodiment of the present disclosure may be a light emitting type display panel, however, it should not be particularly limited. For instance, the display panel DP may be an organic light emitting display panel or a quantum dot light emitting display panel. A light emitting layer of the organic light emitting display panel may include an organic light emitting material. A light emitting layer of the quantum dot light emitting display panel may include a quantum dot and/or a quantum rod. Hereinafter, the organic light emitting display panel will be described as a representative example of the display panel DP.

The anti-reflective panel RPP reduces a reflectance of an external light incident thereto from above the window panel WP. The anti-reflective panel RPP according to the embodiment of the present disclosure may include a retarder and a polarizer. The retarder may be a film type or a liquid crystal coating type and may include a 212 retarder and/or a 214 retarder. The polarizer may be a film type or a liquid crystal coating type. The film type polarizer may include a stretching type synthetic resin film, and the liquid crystal coating type polarizer may include liquid crystals arranged in a predetermined arrangement. The retarder and the polarizer may further include a protective film. The retarder and the polarizer or the protective film may be defined as a base layer of the anti-reflective panel RPP.

The anti-reflective panel RPP according to the embodiment of the present disclosure may include color filters. The color filters may have a predetermined arrangement. The arrangement of the color filters may be determined by taking into account emission colors of pixels included in the display panel DP. The anti-reflective panel RPP may further include a black matrix disposed adjacent to the color filters.

The anti-reflective panel RPP according to the embodiment of the present disclosure may include a destructive interference structure. For instance, the destructive interference structure may include a first reflection layer and a second reflection layer, which are disposed on different layers from each other. A first reflection light and a second reflection light, which are reflected by the first reflection layer and the second reflection layer, respectively, may be destructively interfered, and thus, the reflectance of the external light may be reduced.

The window panel WP according to the embodiment of the present disclosure includes a base layer WP-BS and a light blocking pattern WP-BZ. The base layer WP-BS may include a glass substrate and/or a synthetic resin film. The base layer WP-BS should not be limited to a single-layer structure. The base layer WP-BS may include two or more films coupled to each other by the adhesive member.

The light blocking pattern WP-BZ partially overlaps the base layer WP-BS. The light blocking pattern WP-BZ is disposed on a front surface of the base layer WP-BS and disposed in a light blocking area WP-NT of the base layer WP-BS. The light blocking area WP-NT defines the non-display area ED-NDA of the electronic device ED. An area in which the light blocking pattern WP-BZ is not disposed is defined as a transmission area WP-T of the window panel WP.

The light blocking pattern WP-BZ may be a colored organic layer and may be formed through a coating process. Although not shown separately, the window panel WP may further include a functional coating layer disposed on a front surface of the base layer WP-BS. The functional coating layer may include an anti-fingerprint layer, an anti-reflective layer, and a hard coating layer. The window panel WP and the window layer WL are briefly shown in FIGS. 2B to 2D without distinguishing the base layer WP-BS and the light blocking pattern WP-BZ.

Figure 2B:
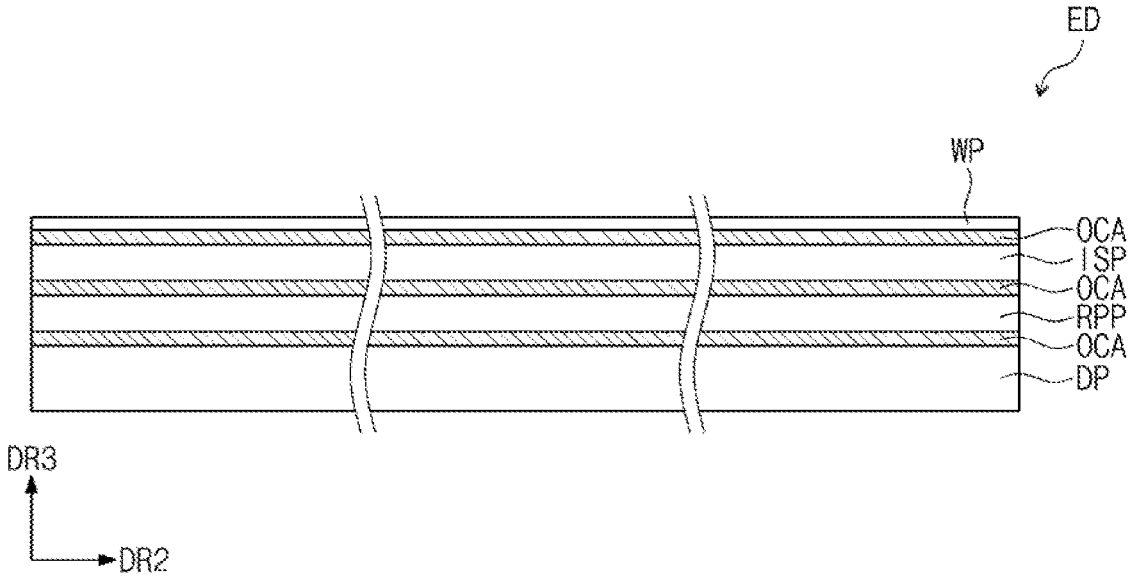
Figure 2C:
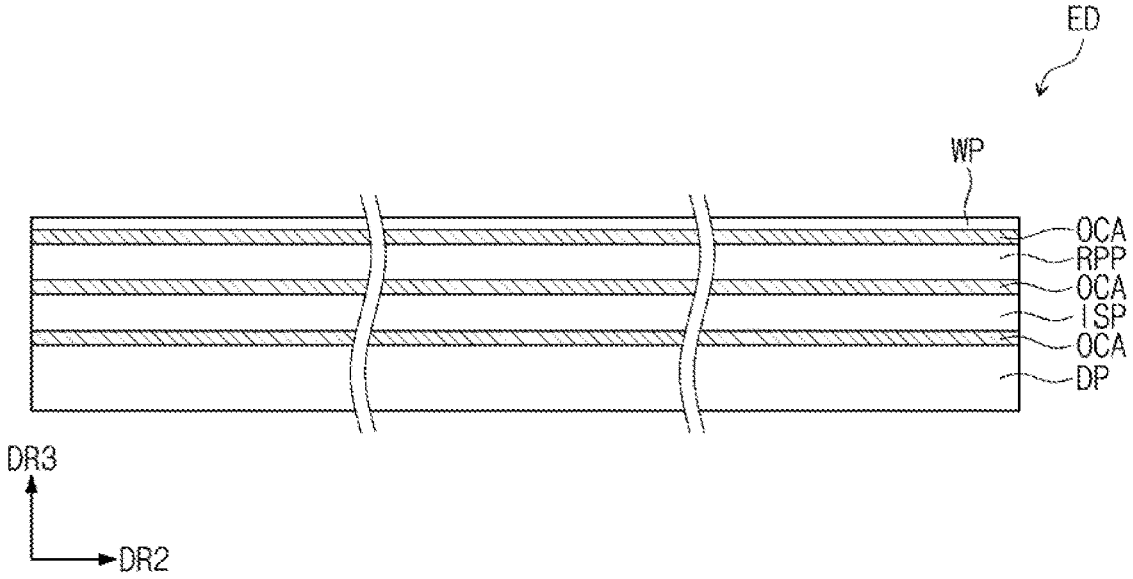

As shown in FIGS. 2B and 2C, the electronic device ED may include the display panel DP, the input sensing panel ISP, the anti-reflective panel RPP, and the window panel WP. The stacking order of the input sensing panel ISP and the anti-reflective panel RPP may be changed.

Figure 2D:
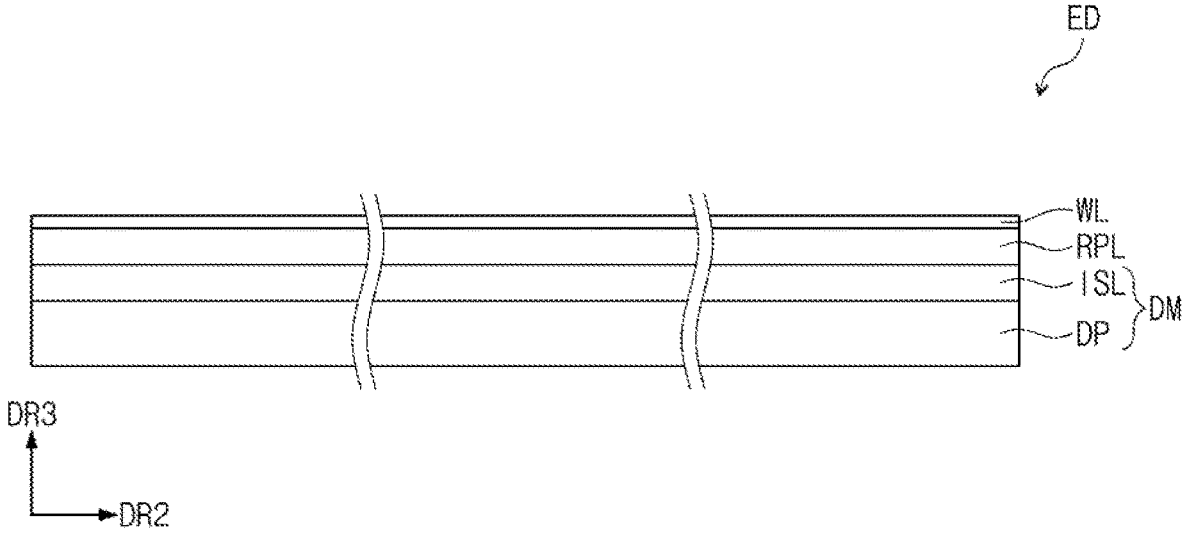

As shown in FIG. 2D, the electronic device ED may include the display panel DP, the input sensing layer ISL, the anti-reflective layer RPL, and the window layer WL. Adhesive members may be omitted from the electronic device ED, and the input sensing layer ISL, the anti-reflective layer RPL, and the window layer WL may be formed on a base surface of the display panel DP through successive processes. The stacking order of the input sensing layer ISL and the anti-reflective layer RPL may be changed.

Figure 3A:
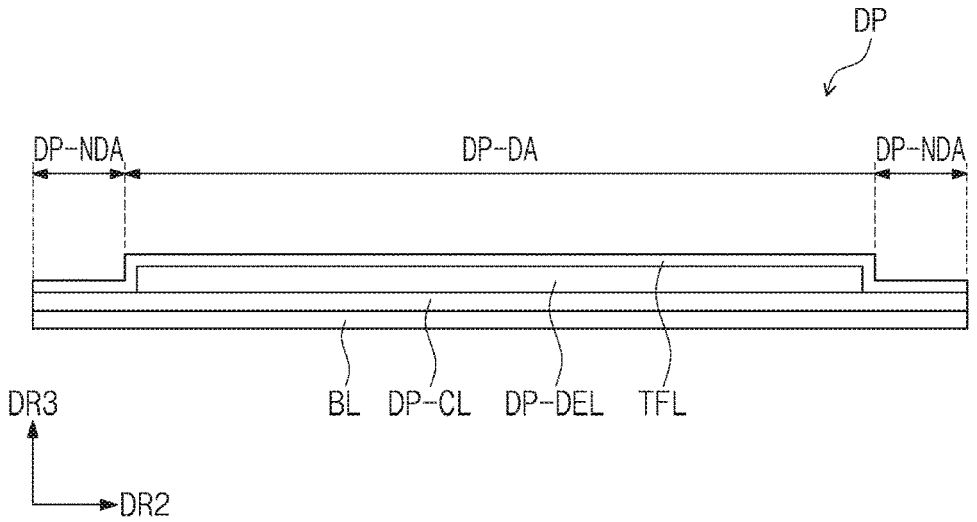
FIGS. 3A and 3B are cross-sectional views showing a display panel according to an embodiment of the present disclosure.
Figure 3B:
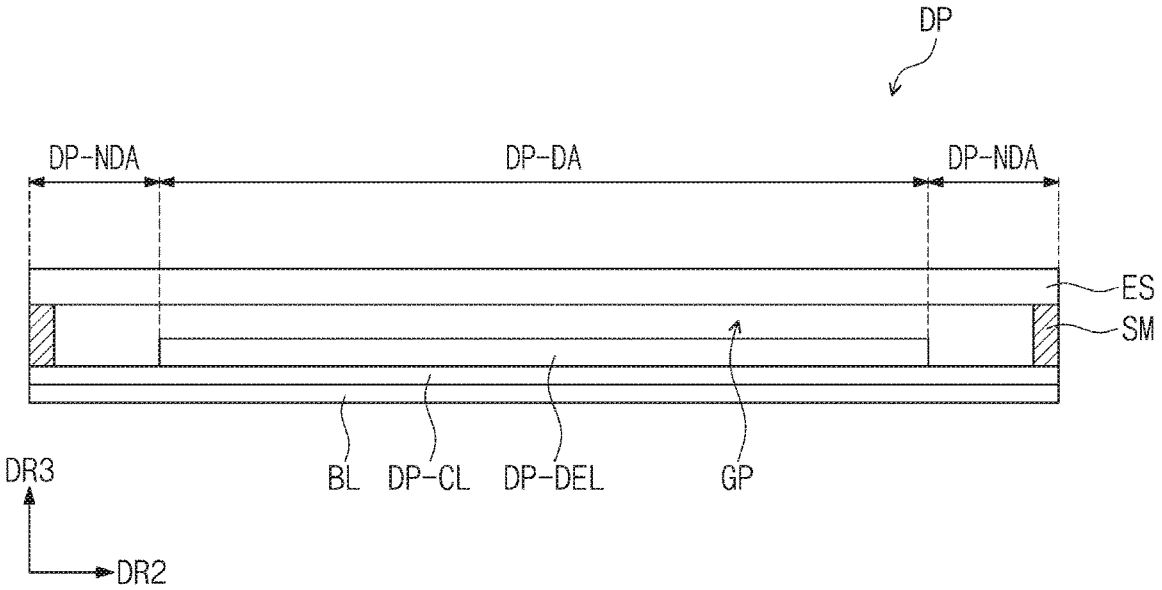

FIGS. 3A and 3B are cross-sectional views showing display panels DP according to an embodiment of the present disclosure.

Referring to FIG. 3A, the display panel DP includes a base layer BL, a circuit element layer DP-CL, a display element layer DP-DEL, and an upper insulating layer TFL, which are disposed on the base layer BL. A display area DP-DA and a non-display area DP-NDA, which respectively correspond to the display area ED-DA and the non-display area ED-NDA shown in FIG. 1, may be defined in the display panel DP. In the present disclosure, the expression "an area corresponds to another area" means that "areas overlap with each other", but is not limited to "areas have the same size and/or the same shape".

The base layer BL may include at least one plastic film. The base layer BL may include a plastic substrate, a glass substrate, a metal substrate, or an organic/inorganic composite substrate.

The circuit element layer DP-CL includes at least one intermediate insulating layer and a circuit element. The intermediate insulating layer includes at least one intermediate inorganic layer and at least one intermediate organic layer. The circuit element includes signal lines and a pixel driving circuit. These will be described in detail later.

The display element layer DP-DEL includes at least one of an organic light emitting diode, an inorganic light emitting diode, and a quantum dot light emitting diode as its light emitting element. The display element layer DP-DEL may further include an organic layer such as a pixel definition layer.

The upper insulating layer TFL includes a plurality of thin layers. Some thin layers are disposed to improve an optical efficiency, and some thin layers are disposed to protect the organic light emitting diodes.

Referring to FIG. 3B, the display panel DP includes a base layer BL, a circuit element layer DP-CL, a display element layer DP-DEL, an encapsulation substrate ES, which are disposed on the base layer BL, and a sealant SM coupling the base layer BL and the encapsulation substrate ES. The encapsulation substrate ES may be spaced apart from the display element layer DP-DEL by a predetermined gap GP. The base layer BL and the encapsulation substrate ES may include a plastic substrate, a glass substrate, a metal substrate, or an organic/inorganic composite substrate. The sealant SM may include an organic adhesive or frit.

Figure 4:
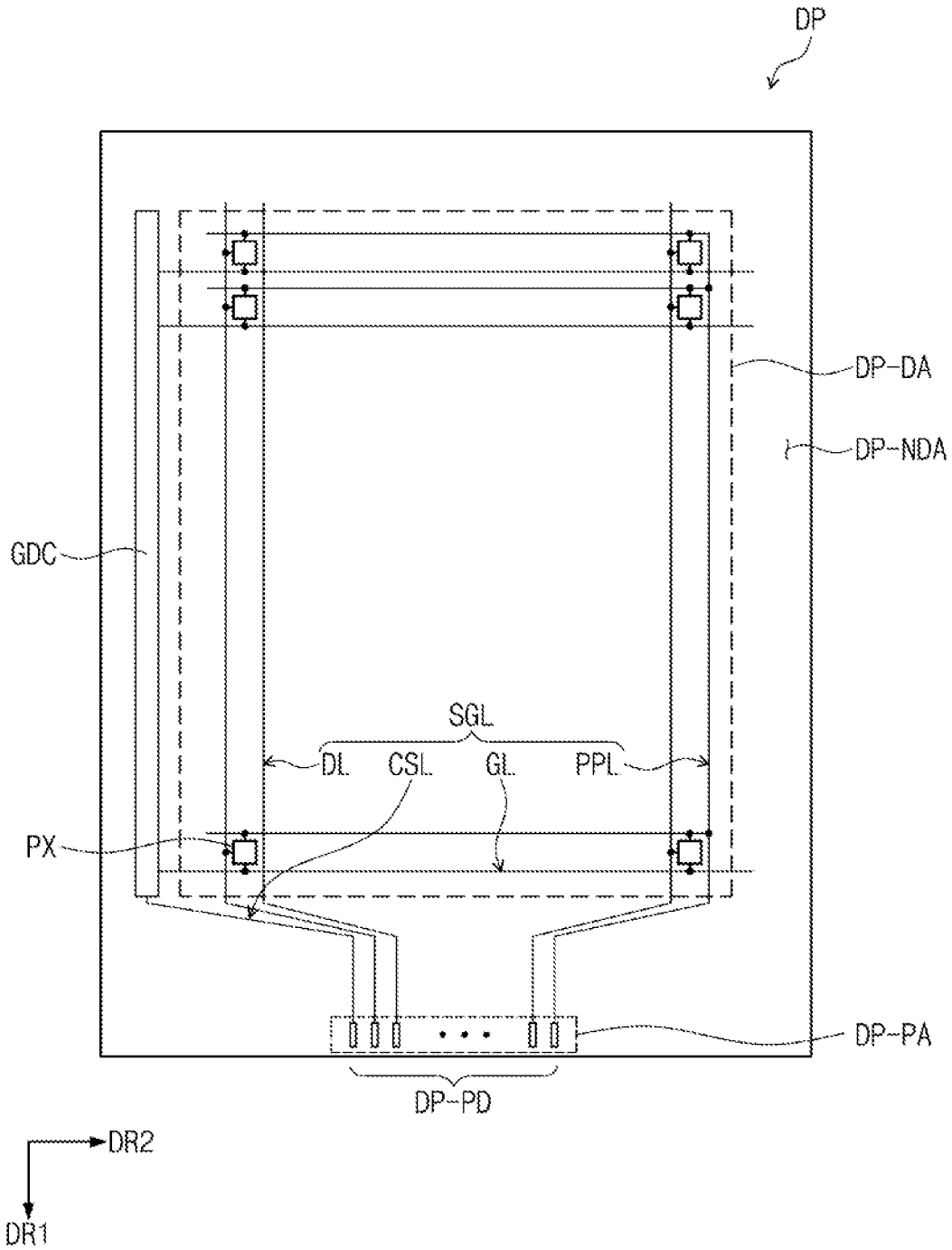
FIG. 4 is a plan view showing a display panel according to an embodiment of the present disclosure.

FIG. 4 is a plan view showing a display panel DP according to an embodiment of the present disclosure.

Referring to FIG. 4, the display panel DP may include a driving circuit GDC, a plurality of signal lines SGL (hereinafter, referred to as "signal lines"), a plurality of signal pads DP-PD (hereinafter, referred to as "signal pads"), and a plurality of pixels PX (hereinafter, referred to as "pixels").

The display area DP-DA may be defined as an area in which the pixels PX are arranged. Each of the pixels PX may include the organic light emitting diode and the pixel driving circuit connected to the organic light emitting diode. The driving circuit GDC, the signal lines SGL, the signal pads DP-PD, and the pixel driving circuit may be included in the circuit element layer DP-CL shown in FIGS. 3A and 3B.

The driving circuit GDC may include a scan driving circuit. The scan driving circuit may generate a plurality of scan signals (hereinafter, referred to as "scan signals") and may sequentially output the scan signals to a plurality of scan lines GL (hereinafter, referred to as "scan lines") described later. The scan driving circuit may further output other control signals to the pixel driving circuit of the pixels PX.

The scan driving circuit may include a plurality of thin film transistors formed through the same processes, e.g., a low temperature polycrystalline silicon (LTPS) process or a low temperature polycrystalline oxide (LTPO) process, as the pixel driving circuit of the pixels PX.

The signal lines SGL may include the scan lines GL, data lines DL, a power line PPL, and a control signal line CSL. Each of the scan lines GL may be connected to a corresponding pixel PX among the pixels PX, and each of the data lines DL may be connected to a corresponding pixel PX among the pixels PX. The power line PPL may be connected to the pixels PX. The control signal line CSL may provide control signals to the scan driving circuit.

The signal lines SGL may overlap the display area DP-DA and the non-display area DP-NDA. The signal lines SGL may include a pad portion and a line portion. The line portion may overlap the display area DP-DA and the non-display area DP-NDA. The pad portion may be connected to an end of the line portion. The pad portion may be disposed in the non-display area DP-NDA and may overlap a corresponding signal pad DP-PD among the signal pads DP-PD. In the non-display area DP-NDA, an area in which the signal pads DP-PD are disposed may be defined as a pad area DP-PA. The pad area DP-PA may be connected to a circuit substrate (not shown).

The line portion connected to the pixel PX may substantially constitute most of the signal lines SGL. The line portion may be connected to transistors of the pixel PX. The line portion may have a single-layer or multi-layer structure, and the line portion may be implemented in a single body or may include two or more portions. The two or more portions may be disposed on different layers and may be connected to each other through a contact hole defined through an insulating layer disposed between the two or more portions.

Figure 5A:
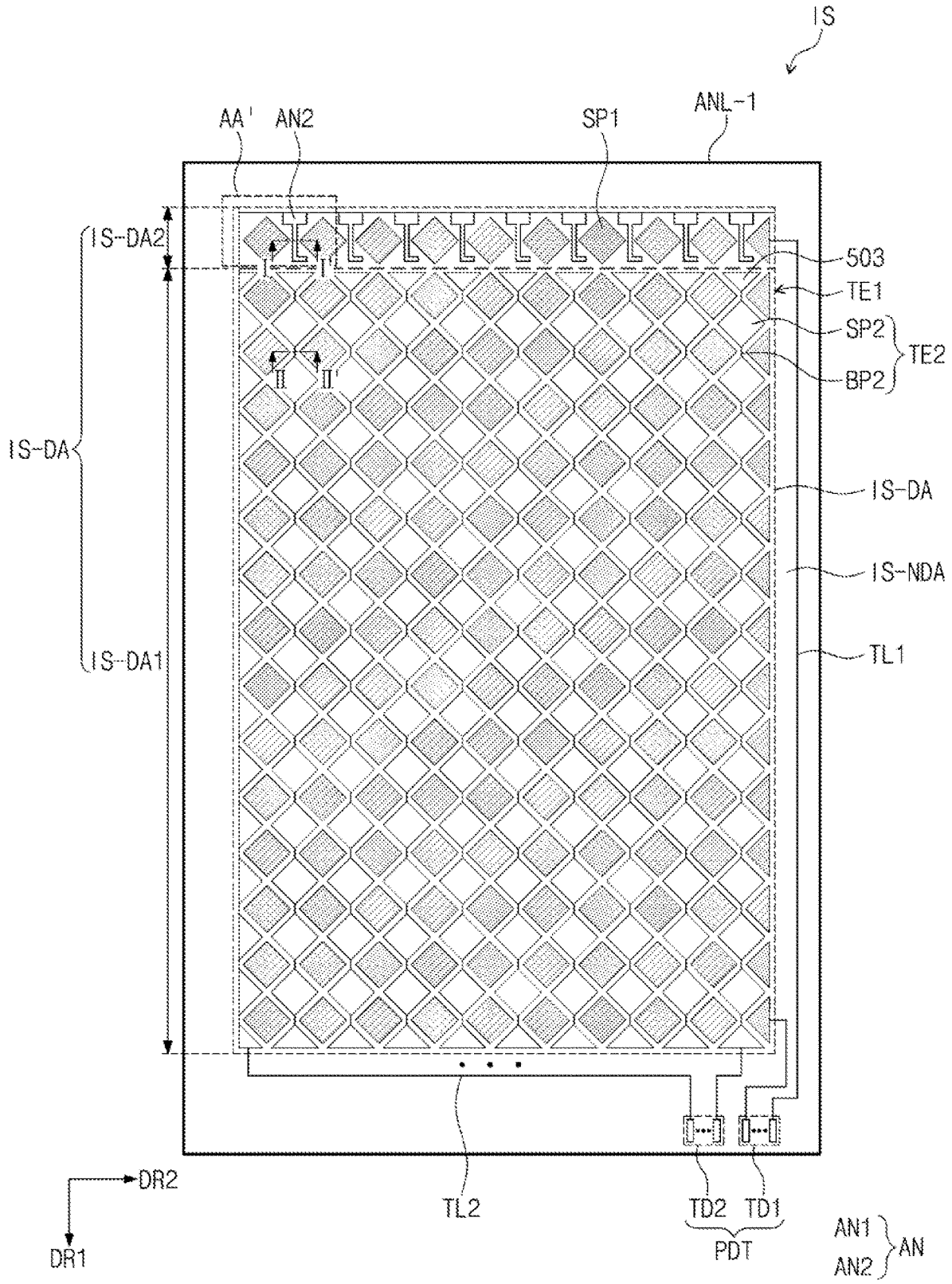
FIGS. 5A and 5B are plan views showing an input sensor and an antenna according to an embodiment of the present disclosure.
Figure 5B:
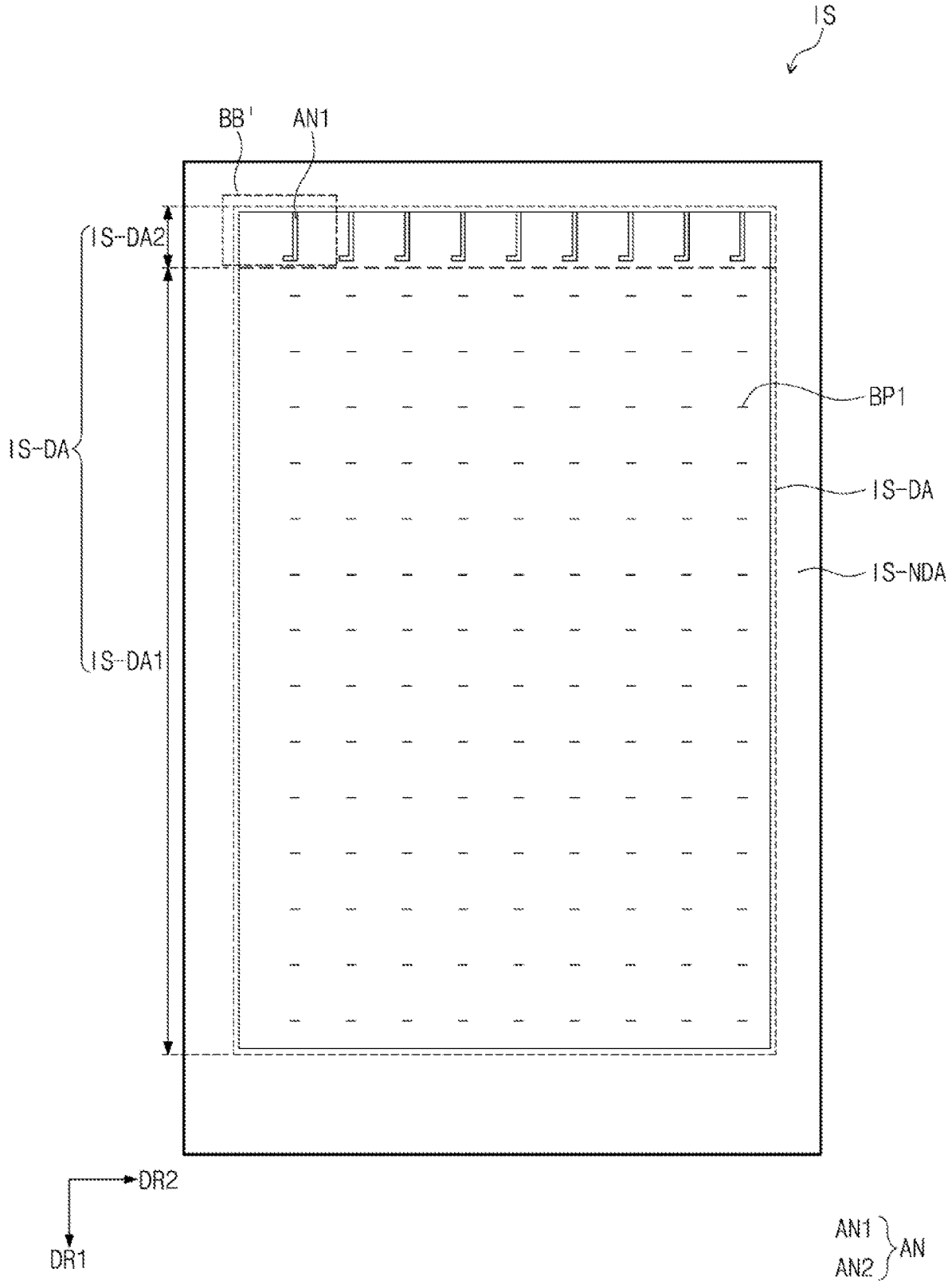

FIGS. 5A and 5B are plan views showing an input sensor IS and an antenna AN according to an embodiment of the present disclosure.

FIG. 5A is a plan view showing a plurality of sensing patterns SP1 and SP2 of the input sensor IS and a second sub-antenna AN2 of the antenna AN, and FIG. 5B is a plan view showing a plurality of bridge elements BP1 of the input sensor IS and a first sub-antenna AN1 of the antenna AN.

The antenna AN may be disposed in a display area IS-DA. For portable electronic devices, e.g., hand-held or wearable devices, it is desirable for the electronic device ED to be small and/or thin, with minimal area allocated for the non-display area. However, to enhance the user experience, the display area IS_DA may be maintained at a relatively large size, whereby it is desirable to embed the antenna AN within the relatively large display area IS-DA. In an embodiment, the antenna AN may be disposed at a position in the display area IS-DA from which a portion of the input sensor IS is removed. For example, the input sensor IS may be disposed in a first area IS-DA1 of the display area IS-DA, and the antenna AN may be disposed in a second area IS-DA2 of the display area IS-DA. The antenna AN may be disposed in an area from which a portion of the input sensor IS disposed in the second area IS-DA2 is removed (refer to FIG. 6A). The antenna AN and the input sensor IS may be disposed on the same layer. The antenna AN may be stacked when the input sensor IS is stacked.

In an embodiment, the antenna AN may be a dipole antenna (hereafter, antenna AN will be interchangeably called a dipole antenna AN). The dipole antenna AN may include the first sub-antenna AN1 which is an antenna structure and a first dipole arm ("first electrode"), and the second sub-antenna AN2 which is an antenna structure and a second dipole arm ("second electrode"). The first and second sub-antennas may be wire-shaped and may be arranged to collectively form a symmetrical structure. The dipole antenna AN may provide a relatively wide bandwidth with a uniform radiation pattern as compared with other antennas. The dipole antenna AN may be formed as printed conductors on the base substrate.

For example, in general, the dipole antenna AN may include two sub-antennas AN1 and AN2 disposed (or printed) with a dielectric layer interposed therebetween. The two sub-antennas AN1 and AN2 may be an upper sub-antenna and a lower sub-antenna, respectively. The antenna AN may be disposed on the same layer as the input sensor IS. For example, referring momentarily to FIG. 7, the first sub-antenna AN1 may be the lower sub-antenna disposed under a third insulating layer IL3, and the second sub-antenna AN2 may be the upper antenna disposed within the third insulating layer IL3. Hereinafter, the input sensor IS and the antenna AN will be described in detail with reference to FIGS. 5A, 5B, 6A, 6B, 7, and 8.

As shown in FIGS. 5A and 5B, the electronic device ED may include a plurality of antennas AN linearly arranged (nine sub-antennas AN2 and nine sub-antennas AN1 are depicted in FIGS. 5A and 5B, respectively). Depending on the application, all or some of the antennas AN may be coupled through a distribution network (composed of combiners and/or dividers) to form an antenna array. In other cases, each of the antennas AN operate independently.

The input sensor IS may include the display area IS-DA and the non-display area IS-NDA defined therein. The display area IS-DA may be an active area activated in response to electrical signals. For example, the display area IS-DA may be an area in which an input is sensed. The display area IS-DA may correspond to the display area ED-DA of the electronic device ED (refer to FIG. 1). When viewed in a plane, the display area IS-DA may overlap the display area DP-DA of the display panel DP (refer to FIG. 4).

The display area IS-DA may include the first area IS-DA1 and the second area IS-DA2. The first area IS-DA1 may correspond to the first area ED-DA1 (refer to FIG. 1) of the electronic device ED (refer to FIG. 1). The second area IS-DA2 may correspond to the second area ED-DA2 (refer to FIG. 1) of the electronic device ED (refer to FIG. 1). The second area IS-DA2 may be closer to one side of the non-display area IS-NDA than the first area IS-DA1 is. For example, the second area IS-DA2 may be an area in the display area IS-DA, which is adjacent to the lower side of the non-display area IS-NDA in the first direction DR1, and in this case, the first area IS-DA1 may correspond to the other area of the display area IS-DA except the second area IS-DA2. In FIG. 5A, the area adjacent to the one side in the first direction DR1 of the non-display area IS-NDA is indicated as the second area IS-DA2. In other embodiments, second area IS-DA2 is located elsewhere (e.g., as in the embodiment of FIG. 15).

The non-display area IS-NDA may surround the display area IS-DA. The non-display area IS-NDA may correspond to the non-display area ED-NDA (refer to FIG. 1) of the electronic device ED (refer to FIG. 1). When viewed in a plan view, the non-display area IS-NDA may overlap the non-display area DP-NDA (refer to FIG. 4) of the display panel DP (refer to FIG. 4).

Referring to FIGS. 5A and 5B, the input sensor IS may include a first sensing electrode TE1, a second sensing electrode TE2, a first sensing line TL1, a second sensing line TL2, and a sensing pad PDT. The input sensor IS may obtain the information about the external input based on a variation in capacitance between a plurality of first sensing electrodes TE1 and a plurality of second sensing electrodes TE2.

The first sensing electrode TE1 may include a plurality of first sensing patterns SP1 arranged and connected in a common row (oriented in the second direction DR2), and a plurality of first bridge elements BP1 each connecting a pair of adjacent first sensing patterns SP1 in the common row. The second sensing electrode TE2 may include a plurality of second sensing patterns SP2 arranged and connected in a common column (oriented in the first direction DR1) and a plurality of second bridge elements BP2 each connecting a pair of adjacent second sensing patterns SP2 in the common column. It is noted here that each of the first sensing patterns SP1 and the second sensing patterns SP2 is herein called a "pattern" because each of these elements are formed by a mesh pattern of thin wires. The bridge elements BP1 may each be a conductive line, and the plurality of bridge elements BP1 (or BP2) may be collectively referred to as a bridge pattern. Each of the first sensing electrode TE1 and the second sensing electrode TE2 may be provided in plural. The first sensing electrode TE1 and the second sensing electrode TE2 may overlap the display area IS-DA. The first sensing patterns SP1 may be arranged in the second direction DR2 crossing the first direction DR1, and the second sensing patterns SP2 may be arranged in the first direction DR1. The first sensing patterns SP1, the second sensing patterns SP2, and the second bridge elements BP2 may be disposed within a third insulating layer IL3 (refer to FIG. 8), and the first bridge elements BP1 may be disposed on a first insulating layer IL1 (refer to FIG. 7). The second insulating layer IL2 may be disposed on the first insulating layer IL'. This will be described in detail with reference to FIGS. 7 and 8. As shown in FIG. 5A, a number of first sensing patterns SP1 may be present in the second area IS-DA2 but second sensing patterns SP2 are omitted from this area. A plurality of second sensing patterns, designated as 503, may be located directly below the second area IS-DA2 and each may have half the surface area of the other second sensing patterns SP2. Second sensing patterns 503 may each be shaped as equilateral triangles.

The first sensing line TL1 may be provided in plural, and the first sensing lines TL1 may be electrically connected to the first sensing electrodes TE1, respectively. The second sensing line TL2 may be provided in plural, and the second sensing lines TL2 may be electrically connected to the second sensing electrodes TE2, respectively. The first sensing lines TL1 and the second sensing lines TL2 may overlap the non-display area IS-NDA.

The sensing pad PDT may be provided in plural, and the sensing pads PDT may include a plurality of first sensing pads TD1 and a plurality of second sensing pads TD2. The first sensing pads TD1 may be respectively connected to the first sensing lines TL1. The second sensing pads TD2 may be respectively connected to the second sensing lines TL2. The sensing pads PDT may overlap the non-display area IS-NDA.

Figure 7:
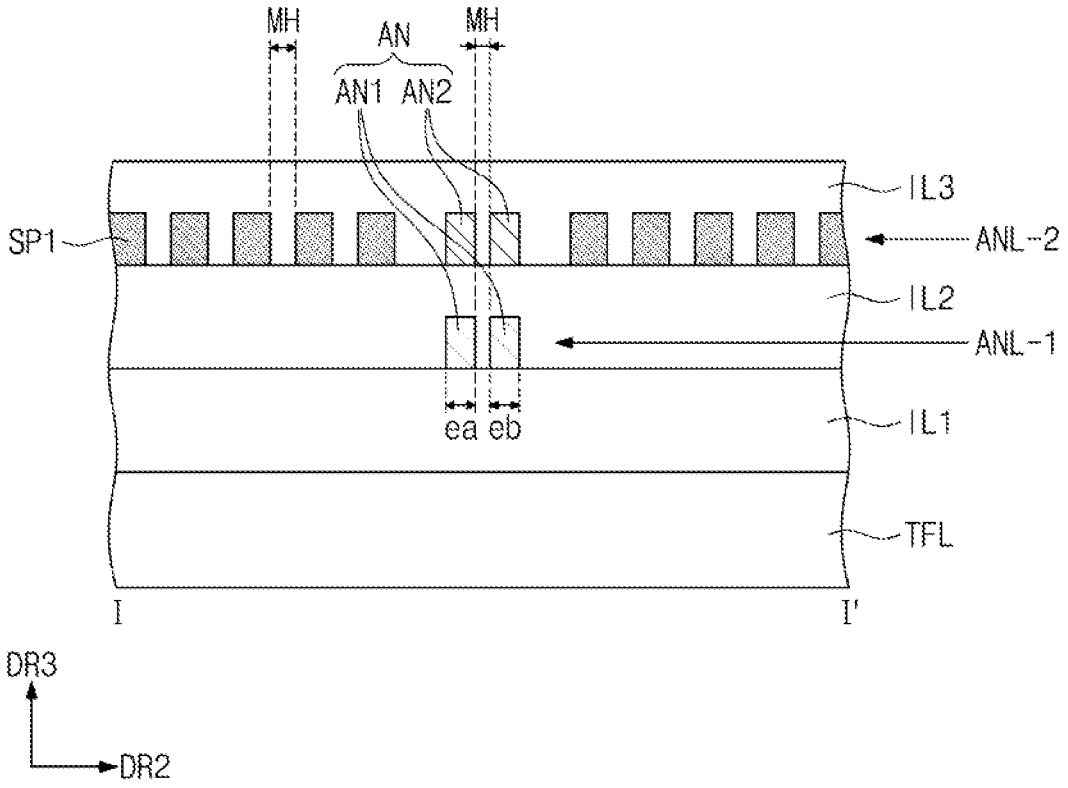
FIG. 7 is a cross-sectional view showing an input sensor and an antenna according to an embodiment of the present disclosure.

Referring to FIGS. 5A and 5B, the antenna AN may include the first sub-antenna AN1 and the second sub-antenna AN2. The first sub-antenna AN1 may be disposed within the same layer as the first bridge elements BP1, and the second sub-antenna AN2 may be disposed within the same layer as the first sensing patterns SP1, the second sensing patterns SP2, and the second bridge elements BP2. For example, as seen in FIG. 7, the second sub-antenna AN2 is disposed in a second antenna layer ANL-2, which is a layer within a third insulating layer IL3, and the first sensing patterns SP1 are disposed within the third insulation layer IL3. The antenna AN may overlap the second area IS-DA2 of the display area IS-DA. Each of the first sub-antenna AN1 and the second sub-antenna AN2 may be provided in plural, and each of the first sub-antennas AN1 and the second sub-antennas AN2 may be arranged in the second direction DR2. The second sub-antenna AN2 may be disposed between an adjacent pair of the first sensing patterns SP1. The first sub-antenna AN1 may overlap the second sub-antenna AN2 when viewed in a plane.

In an embodiment, the second sensing patterns SP2 may not be disposed in the second area IS-DA2 of the input sensor IS. The second sub-antennas AN2 may be disposed in the second area IS-DA2 in place of the second sensing patterns SP2. Each of the second sub-antennas AN2 may be disposed between an adjacent pair of the first sensing patterns SP1 and may be arranged in the second direction DR2. It is noted here that in an alternative embodiment to that shown in FIG. 5A, the first sensing patterns SP1 in the second area IS-DA2 may also be omitted.

The antennas AN may include the same material as the sensing electrodes TE1 and TE2 and may be formed through the same processes. For example, the sensing electrodes TE1 and TE2 and the antennas AN may include a carbon nanotube, a metal material and/or a metal alloy, or a composite material thereof and may have a single-layer or multi-layer structure, however, this is merely exemplary. The antennas AN according to the embodiment of the present disclosure may include a material different from that of the sensing electrodes TE1 and TE2 and may be formed through a separate process. For example, the sensing electrodes TE1 and TE2 may have a multi-layer structure of titanium (Ti), aluminum (Al), and titanium (Ti), which are sequentially stacked, and the antennas AN may include a carbon nanotube, a metal material and/or a metal alloy, or a composite material thereof and may have a single-layer or multi-layer structure. Some examples of the metal material include silver (Ag), copper (Cu), aluminum (Al), gold (Au), platinum (Pt), and combinations thereof.

Figure 6A:
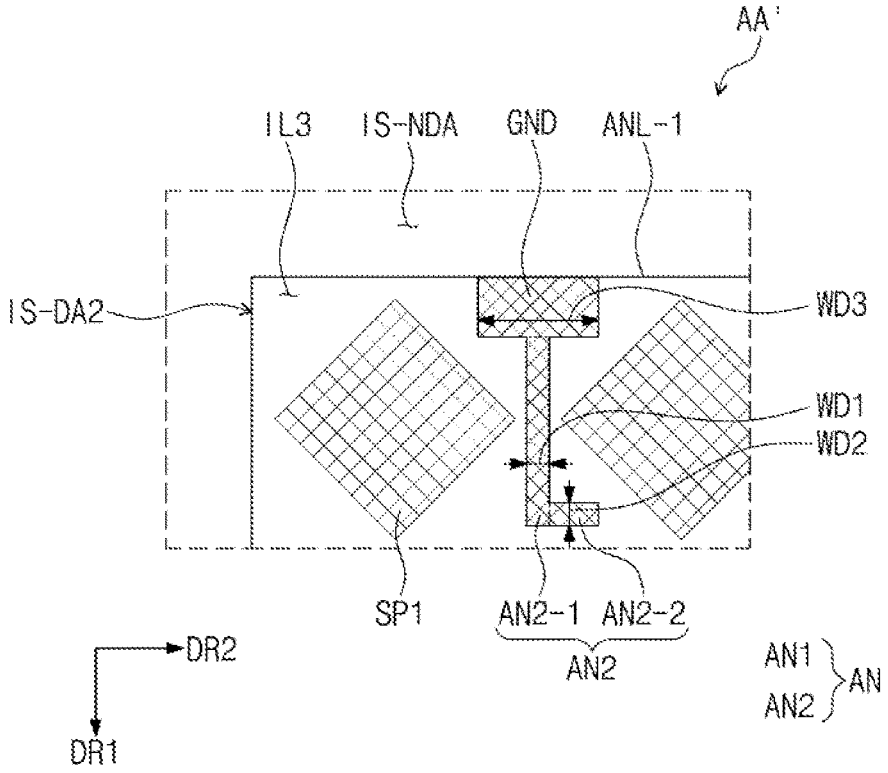
FIGS. 6A and 6B are views showing an antenna according to an embodiment of the present disclosure.
Figure 6B:
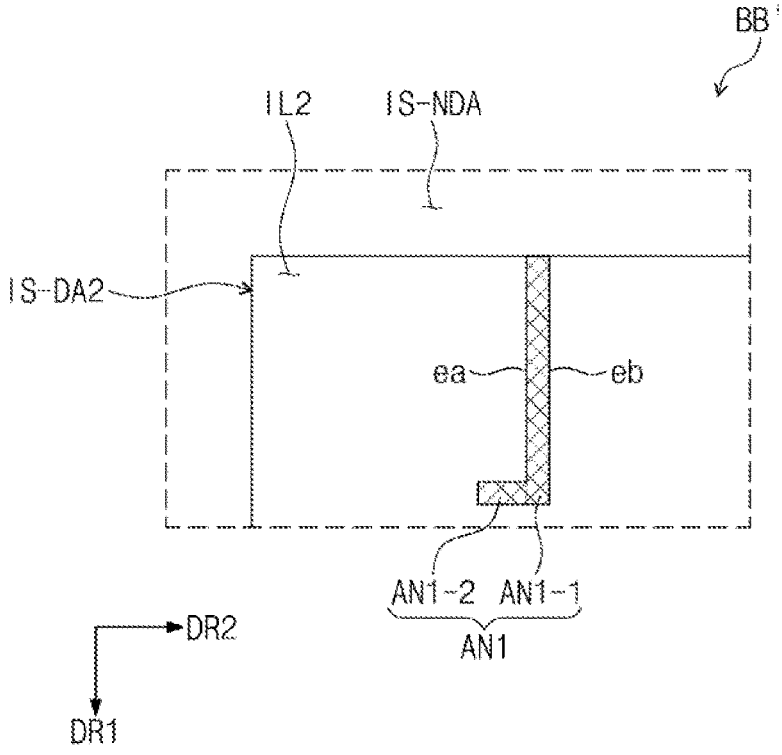
Figure 6C:
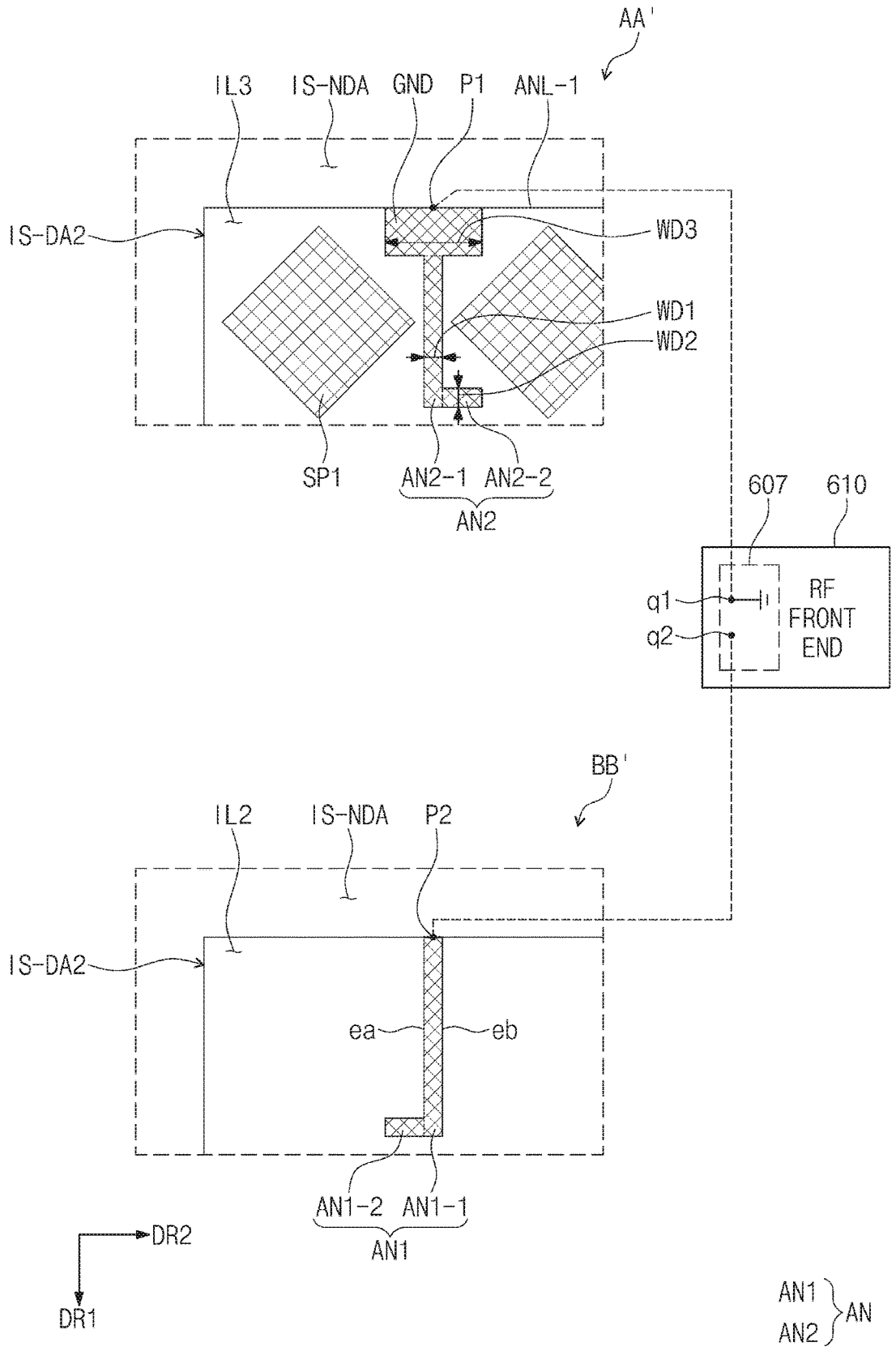
FIG. 6C schematically illustrates an example connection between the antenna of FIGS. 6A and 6B and RF circuitry within the electronic device.

FIGS. 6A and 6B are views showing an antenna according to an embodiment of the present disclosure. FIG. 6A is an enlarged view showing an area AA' of FIG. 5A, and FIG. 6B is an enlarged view showing an area BB' of FIG. 5B. FIG. 6C schematically illustrates a connection between the antenna of FIGS. 6A and 6B and RF circuitry within the electronic device.

Referring to FIG. 6B, the first sub-antenna AN1 may include a first portion AN1-1 and a second portion AN1-2. (The first portion AN1-1 may be considered a "stem portion" of a dipole arm. The second portion AN1-2 may be considered a "folded portion" of the dipole arm.) The first portion AN1-1 may extend in the first direction DR1, and the second portion AN1-2 may extend from one end of the first portion AN1-1 in the second direction DR2 crossing the first direction DR1. In an embodiment, the first portion AN1-1 may have a length longer than a length of the second portion AN1-2. The first portion AN1-1 and the second portion AN1-2 may have the same width as each other. The first portion AN1-1 and the second portion AN1-2 of the first sub-antenna AN1 may each be composed of thin conductors arranged in a mesh, and thereby each have a mesh structure. For example, an edge location $e_a$ may be a location of a left edge conductor of the mesh structure of the first portion AN1-1, where the left edge conductor is oriented in the first direction DR-1. An edge location $e_b$ may be a location of a right edge conductor of the mesh structure of the first portion AN1-1, where the right edge conductor is also oriented in the first direction DR-1. The edge locations $e_a$ and $e_b$ are also depicted in FIG. 7, described below.

Referring to FIG. 6A, the second sub-antenna AN2 may include a third portion AN2-1 extending in the first direction DR1 and a fourth portion AN2-2 extending from one end of the third portion AN2-1 in the second direction DR2 crossing the first direction DR1. The third portion AN2-1 may overlap the first portion AN1-1. The second sub-antenna AN2 may include a ground portion GND connected to the third portion AN2-1. In an embodiment, the second sub-antenna AN2 may have an integral shape including the third portion AN2-1, the fourth portion AN2-2, and the ground portion GND. The third portion AN2-1 may have a width WD1 that is the same as a width WD2 of the fourth portion AN2-2. The ground portion GND may have a width WD3 that is greater than each of the width WD1 of the third portion AN2-1 and the width WD2 of the fourth portion AN2-2. In this case, the width WD3 of the ground portion GND may be a length in the second direction DR2 of the ground portion GND. For example, although the width WD3 of the ground portion GND is depicted as several times larger than the width WD1 of the third portion AN2-1, it may be between one and two orders of magnitude larger. In one example, the width WD1 of the third portion AN2-1 may be about 0.0025 mm and the width WD3 of the ground portion GND may be about 1.5 mm.

In an embodiment, the third portion AN2-1 and the first portion AN1-1 may have substantially the same area as each other, and the fourth portion AN2-2 and the second portion AN1-2 may have substantially the same area as each other. The third portion AN2-1 may overlap the first portion AN1-1. The fourth portion AN2-2 may be substantially parallel to the second portion AN1-2 and may extend in a direction symmetrical with respect to the second portion AN1-2 about an axis running down the center of the first or second portions AN-1, AN-2, as viewed in a plane (an axis oriented in the first direction DR1). The second portion AN1-2 may extend in the opposite direction of the second direction DR2. For example, if DR2 is considered the "x" direction, the second portion AN1-2 may be considered to extend in the −x direction and the fourth portion AN2-2 may be considered to extend in the +x direction. The first portion AN1-1 and the third portion AN2-1 may extend by the same length in the first direction DR1, and the second portion AN1-2 and the fourth portion AN2-2 may extend by the same length in the second direction DR2.

The second sub-antenna AN2 may be disposed between an adjacent pair of the first sensing patterns SP1. For instance, the second sensing patterns SP2 (refer to FIG. 5A) disposed between the first sensing patterns SP1 may be removed in the second area IS-DA2. The second sub-antenna AN2 may be disposed in spaces from which the second sensing patterns SP2 are removed. Since the second area IS-DA2 is disposed adjacent to the non-display area IS-NDA (refer to FIG. 5A) and the images IM/icons in the second area IS-DA2 may be such that a frequency of a user input in this area is relatively low, touch input sensing may be unimportant or irrelevant in this area. Therefore, touch sensing capability that otherwise utilizes the second sensing patterns SP2 may be omitted from the second area IS-DA2 without negatively impacting the user experience, and the antenna AN may be disposed in this area after removing portions of the second sensing patterns SP2 in the second area IS-DA2.

The first sensing patterns SP1 and the second sub-antenna AN2 may each have a mesh structure through which a plurality of mesh openings MH are defined. Although not shown in figures, the second sensing patterns SP2 (refer to FIG. 5A) may also have a mesh structure (the first sub-antenna AN1 has a mesh structure as seen in FIG. 6B). The first sub-antenna AN1 and the second sub-antenna AN2 may have the mesh structure so that the image IM provided from the display area DP-DA transmits therethrough. The mesh structure may be referred to as a lattice structure. The mesh structure may include the mesh openings MH with uniform size. In other cases the mesh openings MH have a variety of sizes, which may depend on a size of the pixel PX (refer to FIG. 4) of the display area DP-DA. In more detail, the display area IS-DA (refer to FIG. 5A) may be divided into a light emitting area and a non-light-emitting area. The light emitting area may correspond to an area in which the image IM transmits through the mesh openings MH, and the non-light-emitting area may correspond to an area in which wire conductors of the first and second sensing patterns SP1 and SP2 and the first and second sub-antennas AN1 and AN2 are substantially disposed. In an embodiment, the first sub-antenna AN1 and the second sub-antenna AN2 may be disposed to overlap not only the non-light-emitting area but also the light emitting area of the display area IS-DA. The first sub-antenna AN1 and the second sub-antenna AN2 may each include a transparent material.

FIG. 6C schematically illustrates how antenna AN may be connected to RF circuitry within the electronic device ED. The antenna AN may be connected to RF front end (RF circuitry) 610, which routes a transmit signal to the antenna AN in a transmission operation and/or receives a signal from the antenna AN in a receiving operation. The RF front end 610 includes a transmission line 607, which has a ground conductor q1 and a signal conductor q2. The transmission line medium of transmission line 607 may be microstrip, in which case the ground conductor q1 is a ground plane and the signal conductor q2 is spaced from the ground plane by a dielectric medium. Alternatively, the transmission line medium is coplanar waveguide, stripline, or an alternative. The ground conductor q1 may be electrically connected to an input point P1 of the ground portion GND of the second sub-antenna AN2. The signal conductor q2 may be electrically connected to an input point P2 of the first sub-antenna AN1. In this manner, the antenna AN is properly fed as a dipole antenna. A balun may be included within the RF front end 610 for driving the dipole antenna AN.

Figure 8:
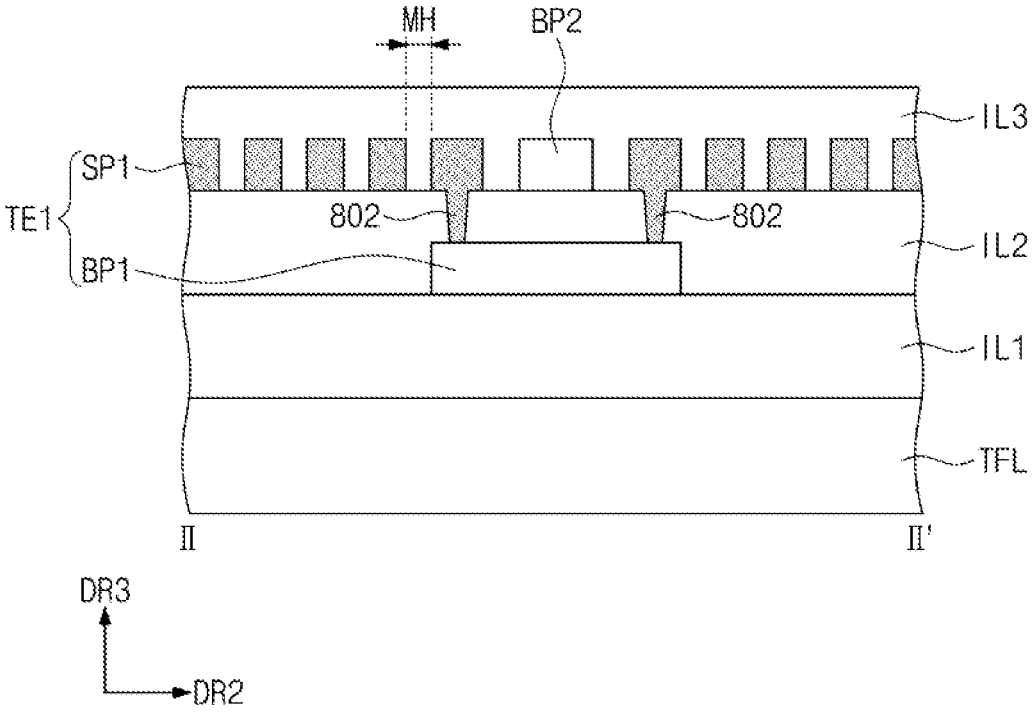
FIG. 8 is a cross-sectional view showing an input sensor according to an embodiment of the present disclosure.

FIG. 7 is a cross-sectional view showing an input sensor and an antenna according to an embodiment of the present disclosure. FIG. 7 is a cross-sectional view taken along a line I-I' of FIG. 5A. FIG. 8 is a cross-sectional view showing an input sensor according to an embodiment of the present disclosure. FIG. 8 is a cross-sectional view taken along a line II-IF of FIG. 5A.

Referring to FIGS. 7 and 8, the input sensor IS and the antenna AN may include the first and second bridge elements BP1 and BP2, the first and second sensing patterns SP1 and SP2, the first and second sub-antennas AN1 and AN2, the first insulating layer ILL the second insulating layer IL2, and a third insulating layer IL3. The input sensor IS and the antenna AN may have the same stack structure.

Each of the first, second, and third insulating layers ILL IL2, and IL3 may include an inorganic material or an organic material. In an embodiment, the first insulating layer IL1 and the second insulating layer IL2 may be an inorganic layer including an inorganic material. The inorganic layer may include at least one of aluminum oxide, titanium oxide, silicon oxide, silicon oxynitride, zirconium oxide, and hafnium oxide. The third insulating layer IL3 may include an organic layer. The organic layer may include at least one of an acrylic-based resin, a methacrylic-based resin, a polyisoprene, a vinyl-based resin, an epoxy-based resin, a urethane-based resin, a cellulose-based resin, a siloxane-based resin, a polyimide-based resin, a polyamide-based resin, and a perylene-based resin. In the embodiment, the second insulating layer IL2 may include an insulating material having a predetermined dielectric constant.

In FIG. 7, the antenna AN may include the first sub-antenna AN1 and the second sub-antenna AN2. The first sub-antenna AN1 may be disposed in layer ANL-1 which is a layer that is on the first insulating layer IL'. The layer ANL-1 may also be considered to be within the second insulating layer IL2. The second sub-antenna AN2 may be disposed on the second insulating layer IL2. The second sub-antenna AN2 may be in layer ANL-2, which may be considered to be within the third insulating layer IL3. The second sub-antenna AN2 may be disposed on the same layer as the first sensing pattern SP1. The second insulating layer IL2 may be disposed between the first sub-antenna AN1 and the second sub-antenna AN2. The first sub-antenna AN1 and the second sub-antenna AN2 may have different electrical polarities from each other (as in a dipole). For example, when the first sub-antenna AN1 has a negative polarity, the second sub-antenna AN2 has a positive polarity, and when the first sub-antenna AN1 has the positive polarity, the second sub-antenna AN2 has the negative polarity. In an embodiment, the first sub-antenna AN1 and the second sub-antenna AN2 may be fed in various ways. In the present embodiment, the first sub-antenna AN1 and the second sub-antenna AN2 may be fed through a microstrip feeding method (as described above in connection with FIG. 6C) and may transmit and receive electrical signals to and from each other according to a dipole mechanism. The third insulating layer IL3 may be disposed on the second insulating layer IL2 and may cover the first sensing pattern SP1 and the second sub-antenna AN2.

As described with reference to FIG. 6A, the first sensing patterns SP1 and the first and second sub-antennas AN1 and AN2 may have the mesh structure through which the mesh openings MH are defined. The mesh structure may be referred to as the lattice structure. The mesh openings MH of the mesh structure may have various sizes depending on the size of the pixel PX (refer to FIG. 4) of the display area DP-DA (refer to FIG. 4).

In FIG. 8, the input sensor IS may include the first sensing pattern SP1, the first bridge element BP1, and the second bridge element BP2.

The first insulating layer IL1 may be disposed directly on the upper insulating layer TFL. The upper insulating layer TFL may be defined as a base surface including a thin film encapsulation layer. In an embodiment, the input sensor IS and the antennas AN1 and AN2 may be disposed directly on the upper insulating layer TFL defined as the base surface. In an embodiment, the first insulating layer IL1 may be omitted.

The first bridge element BP1 may be disposed on the first insulating layer ILL The first sensing pattern SP1 and the second bridge element BP2 may be disposed on the second insulating layer IL2.

Each of the bridge element BP1 and BP2 and the sensing pattern SP1 and SP2 may have a single-layer structure or a multi-layer structure of layers stacked in the third directional axis DR3. The sensing pattern having the multi-layer structure may include two or more layers among transparent conductive layers and metal layers. The sensing pattern having the multi-layer structure may include metal layers including different metal materials. The transparent conductive layer may include indium tin oxide (ITO), indium zinc oxide (IZO), zinc oxide (ZnO), indium tin zinc oxide (ITZO), PEDOT, a metal nanowire, or a graphene. The metal layer may include molybdenum, silver, titanium, copper, aluminum, or alloys thereof. For instance, each of the bridge elements BP1 and BP2 and the sensing patterns SP1 and SP2 may have a three-metal-layer structure of titanium/aluminum/titanium. A first bridge element BP1 may electrically connect edge conductors of adjacent first sensing patterns SP1 through a pair of vias 802.

Figure 9:
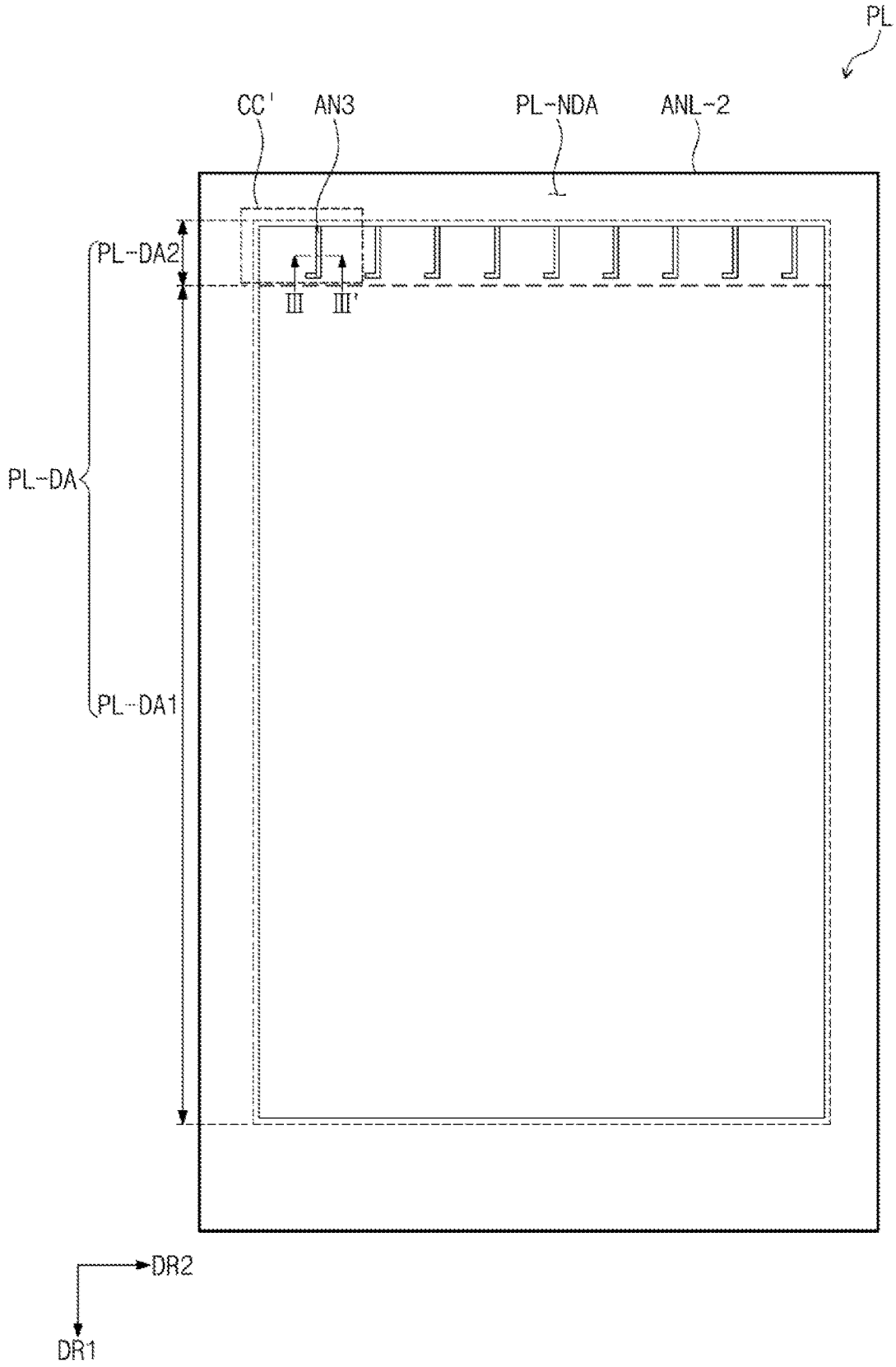
FIG. 9 is a plan view showing an antenna according to an embodiment of the present disclosure.

FIG. 9 is a plan view showing an antenna AN according to another embodiment of the present disclosure. FIG. 9 is a plan view showing a second antenna layer ANL-2 according to an embodiment of the present disclosure.

FIG. 9 shows an electronic device ED including an antenna AN according to another embodiment different from the embodiment of FIGS. 5A and 5B.

Referring to FIG. 9, the antenna AN may include a first antenna layer ANL-1 (refer to FIG. 5A) and a second antenna layer ANL-2. The second antenna layer ANL-2 may be disposed on the first antenna layer ANL-1.

The present embodiment will be described with reference to FIGS. 5A and 9. The second sub-antenna AN2 (refer to FIG. 5A) may be disposed on the first antenna layer ANL-1, and a third sub-antenna AN3 may be disposed on the second antenna layer ANL-2. The third sub-antenna AN3 may correspond to the first sub-antenna AN1 (refer to FIG. 5A) according to the embodiment of FIG. 5A. That is, the antenna AN according to the embodiment of the present disclosure may include the first antenna layer ANL-1 stacked with the input sensor IS and the second antenna layer ANL-2 separately stacked on the first antenna layer ANL-1 in the form of film. The first antenna layer ANL-1 may include the second sub-antenna AN2 (refer to FIG. 5A) corresponding to a lower antenna of a dipole antenna, and the second antenna layer ANL-2 may include the third sub-antenna AN3 corresponding to an upper antenna of the dipole antenna. Either the first antenna layer ANL-1 or the second antenna layer ANL-2 may include a ground portion (not shown).

In the present embodiment, the second sub-antenna AN2 (refer to FIG. 5A) may be referred to as a first sub-antenna, and the third sub-antenna AN3 may be referred to as a second sub-antenna.

In FIG. 9, the second sub-antenna AN2 (refer to FIG. 5A) and the third sub-antenna AN3 may extend in different directions from each other. For example, the second sub-antenna AN2 may extend in one side of the second direction DR2, and the third sub-antenna AN3 may extend in the other side of the second direction DR2.

In an embodiment, the second antenna layer ANL-2 may correspond to a pattern layer PL separated from the input sensor. The pattern layer PL may overlap the display area. The pattern layer PL may include a first area PL-DA1 and a second area PL-DA2. The first area PL-DA1 may correspond to the first area IS-DA1 of the input sensor IS (refer to FIG. 5A), and the second area PL-DA2 may correspond to the second area IS-DA2 of the input sensor IS (refer to FIG. 5A). The third sub-antenna AN3 may be disposed in the second area PL-DA2. The pattern layer PL may include a transmissive film. The pattern layer PL may include an insulating material having a predetermined dielectric constant. For example, the pattern layer PL may include at least one of an acrylic-based resin, a methacrylic-based resin, a polyisoprene, a vinyl-based resin, an epoxy-based resin, a urethane-based resin, a cellulose-based resin, a siloxane-based resin, a polyamide-based resin, and a perylene-based resin.

Figure 10:
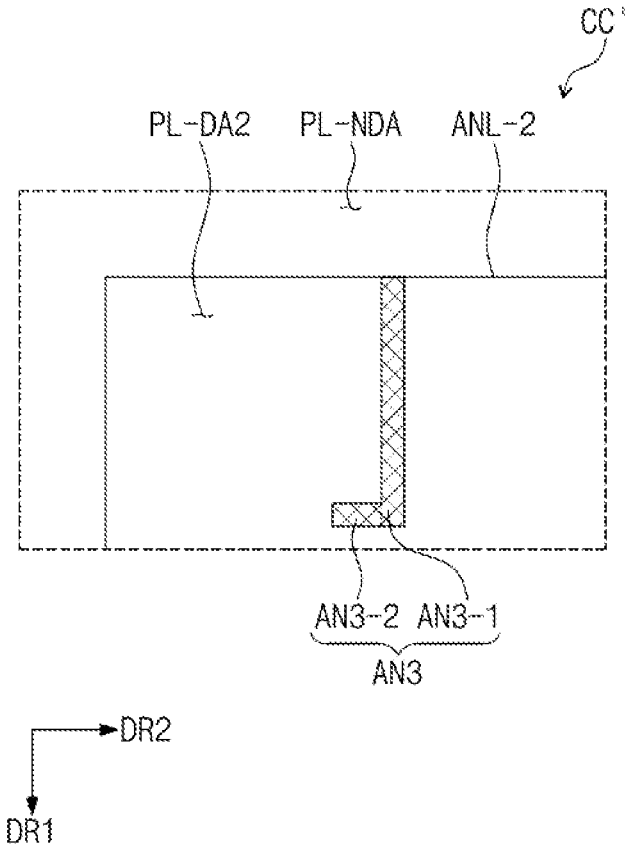
FIG. 10 is a view showing an antenna according to an embodiment of the present disclosure.

FIG. 10 is a view showing an antenna according to an embodiment of the present disclosure. FIG. 10 is an enlarged view showing an area CC' of FIG. 9.

Referring to FIG. 10, the third sub-antenna AN3 may include a fifth portion AN3-1 and a sixth portion AN3-2. The fifth portion AN3-1 may extend in the first direction DR1, and the sixth portion AN3-2 may extend in the second direction DR2. The fifth portion AN3-1 of the third sub-antenna AN3 may overlap the third portion AN2-1 (refer to FIG. 6A) of the second sub-antenna AN2 (refer to FIG. 5A). The sixth portion AN3-2 of the third sub-antenna AN3 may not overlap the fourth portion AN2-2 (refer to FIG. 6A) of the second sub-antenna AN2 (refer to FIG. 5A). The sixth portion AN3-2 of the third sub-antenna AN3 may extend in the other side of the second direction DR2, which is opposite to one side of the second direction DR2 in which the fourth portion AN2-2 of the second sub-antenna AN2 extends. In an embodiment, the third sub-antenna AN3 may have a polarity that is electrically different from that of the second sub-antenna AN2. The third sub-antenna AN3 may be a transparent electrode. The third sub-antenna AN3 may have a mesh structure. In an embodiment, the third sub-antenna AN3 may further include a ground portion (not shown). The ground portion may be connected to the fifth portion AN3-1.

Figure 11:
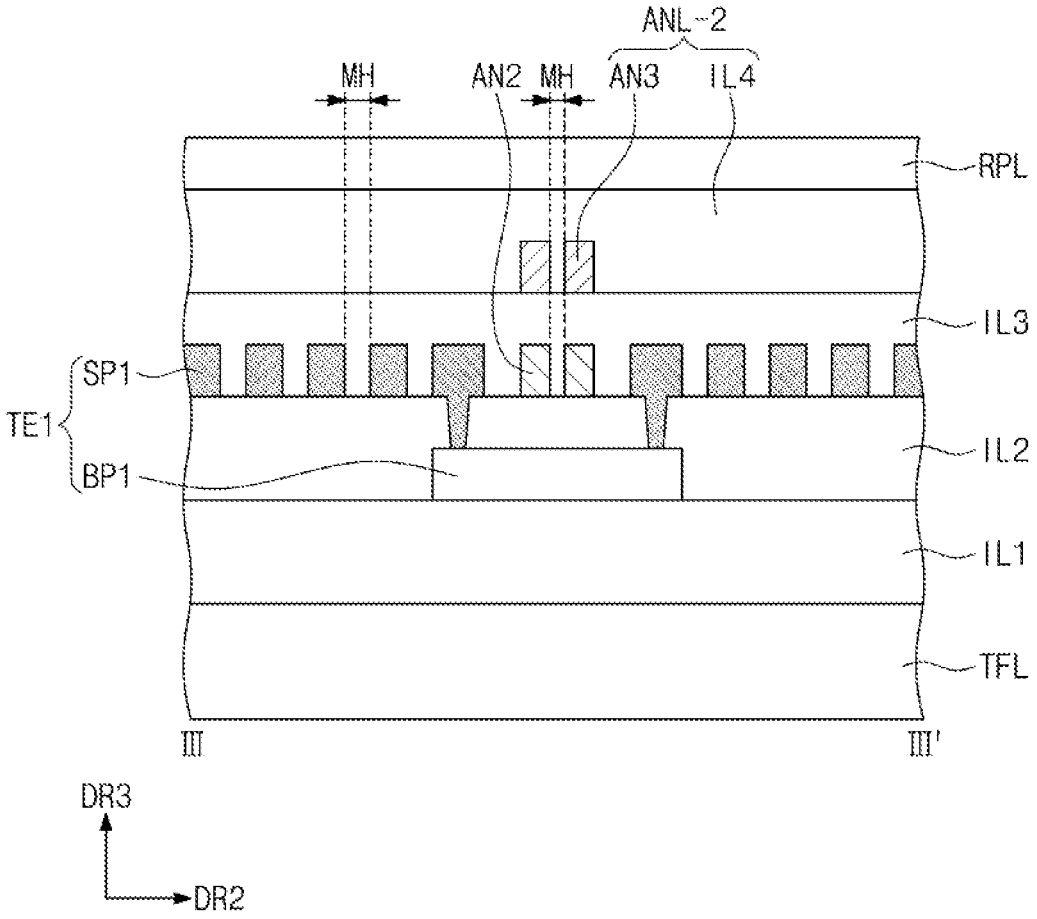
FIG. 11 is a cross-sectional view showing an input sensor and an antenna according to an embodiment of the present disclosure.

FIG. 11 is a cross-sectional view showing an input sensor and an antenna according to an embodiment of the present disclosure. FIG. 11 is a cross-sectional view taken along a line of FIG. 9.

Referring to FIG. 11, the third sub-antenna AN3 may be disposed on the third insulating layer IL3. The third insulating layer IL3 may be disposed on the second insulating layer IL2 and may cover the first sensing patterns SP1 and the second sub-antenna AN2. The third insulating layer IL3 may include a transmissive film. The third insulating layer IL3 may be the pattern layer PL of FIG. 9. The third insulating layer IL3 may include the insulating material having the predetermined dielectric constant.

In FIG. 11, the first sensing electrode TE1 may include the first sensing pattern SP1 disposed on the second insulating layer IL2 and the first bridge element BP1 disposed on the first insulating layer IL1. In an embodiment, the third sub-antenna AN3 may be covered by a fourth insulating layer IL4. The anti-reflective layer RPL may be disposed on the fourth insulating layer IL4.

Figure 12:
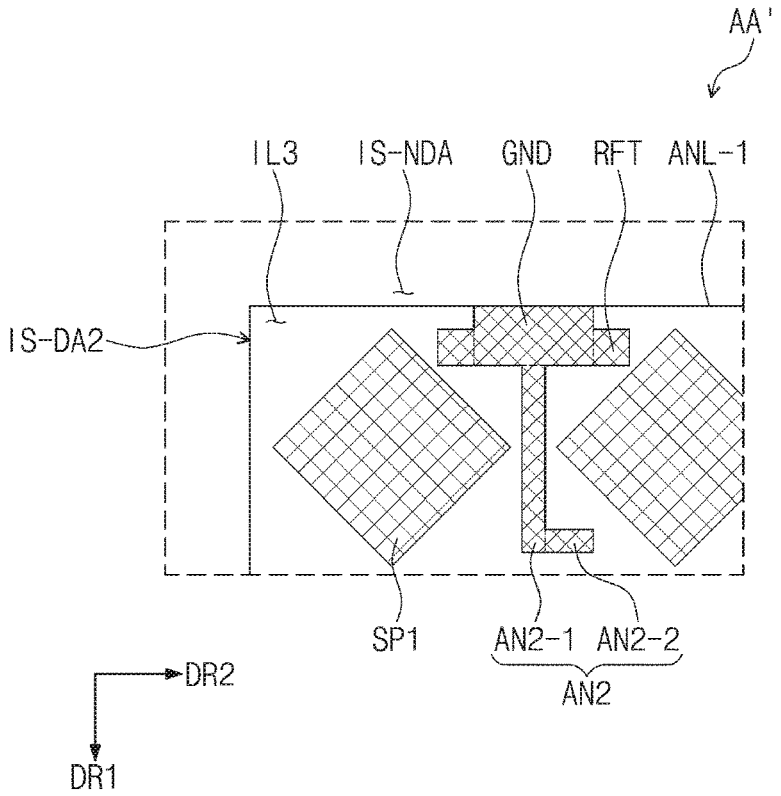
FIG. 12 is a view showing an antenna according to an embodiment of the present disclosure.

FIG. 12 is a view showing an antenna according to an embodiment of the present disclosure. FIG. 12 is an enlarged view showing an area AA' of FIG. 5A.

Referring to FIG. 12, the antenna AN may further include a reflective pattern RFT. In an embodiment, a second sub-antenna AN2 may include at least one reflective pattern RFT. The reflective pattern RFT may compensate for disadvantages of the dipole antenna that provides a broad band width but has radiation pattern with no directivity. That is, the reflective pattern RFT may increase a gain of the antenna AN according to the embodiment of the present disclosure.

In an embodiment, the second sub-antenna AN2 may include a ground portion GND. At least one reflective pattern RFT may be connected to at least one side of the ground portion GND. In an embodiment, at least one reflective pattern RFT may extend from one side or both sides of the ground portion GND and may have an integral shape with the ground portion GND.

Figure 13:
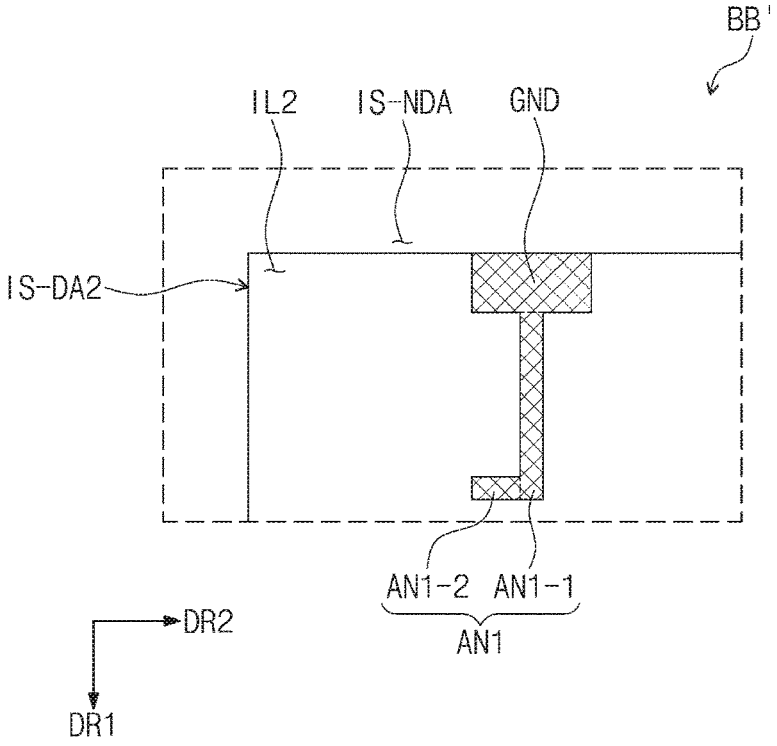
FIG. 13 is a view showing an antenna according to an embodiment of the present disclosure.

FIG. 13 is a view showing an antenna according to an embodiment of the present disclosure. FIG. 13 is an enlarged view showing an area BB' of FIG. 5B.

In FIG. 13, a first sub-antenna AN1 disposed within the second insulating layer IL2 may include a ground portion GND. In this case, the ground portion GND of the first sub-antenna AN1 may be connected to the ground conductor q1 of the transmission line 607 in FIG. 6C. Further, the second sub-antenna AN2 disposed within the third insulating layer IL3 (see FIGS. 5A-7) would not have the ground portion GND but would instead be connected through its third portion AN2-1 to the signal conductor q2 of the transmission line 607. That is, the ground portion GND may be disposed on only one of the second sub-antenna AN2 (see FIG. 5A) and the first sub-antenna AN1. The ground portion GND may extend from one end of a first portion AN1-1 of the first sub-antenna AN1 and may be disposed adjacent to a non-display area IS-NDA. The ground portion GND may have a mesh structure.

Figure 14:
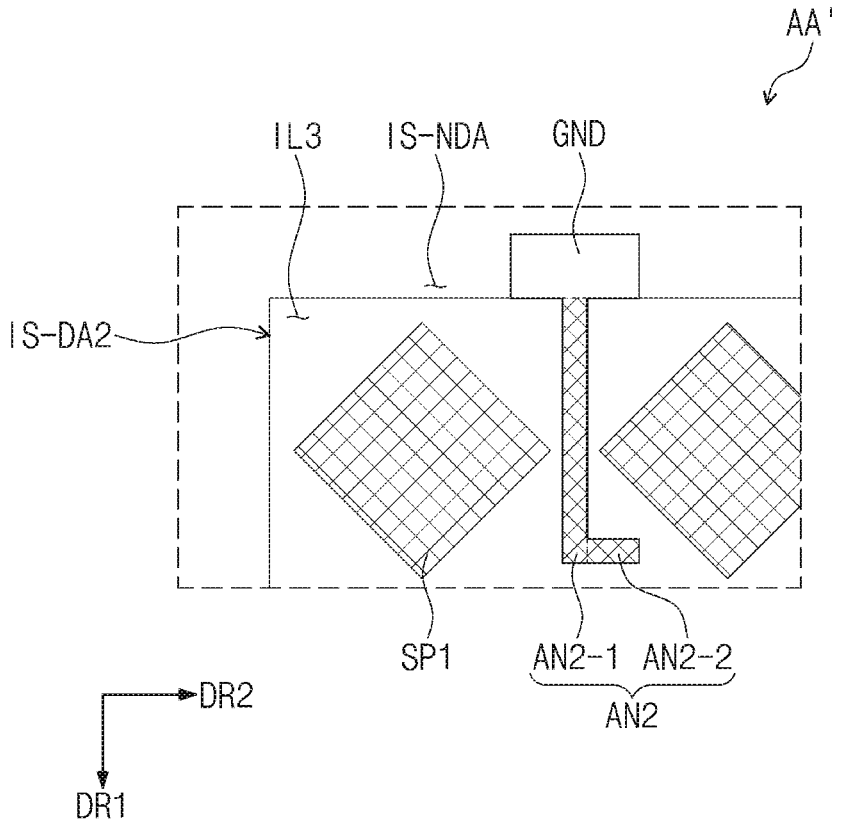
FIG. 14 is a view showing an antenna according to an embodiment of the present disclosure.

FIG. 14 is a view showing an antenna according to an embodiment of the present disclosure. FIG. 14 is an enlarged view showing an area AA' of FIG. 5A.

Referring to FIG. 14, compared to FIG. 6A, a ground portion GND may be disposed in a non-display area IS-NDA. In an embodiment, the ground portion GND may extend from one end of a third portion AN2-1 of a second sub-antenna AN2.

Figure 15:
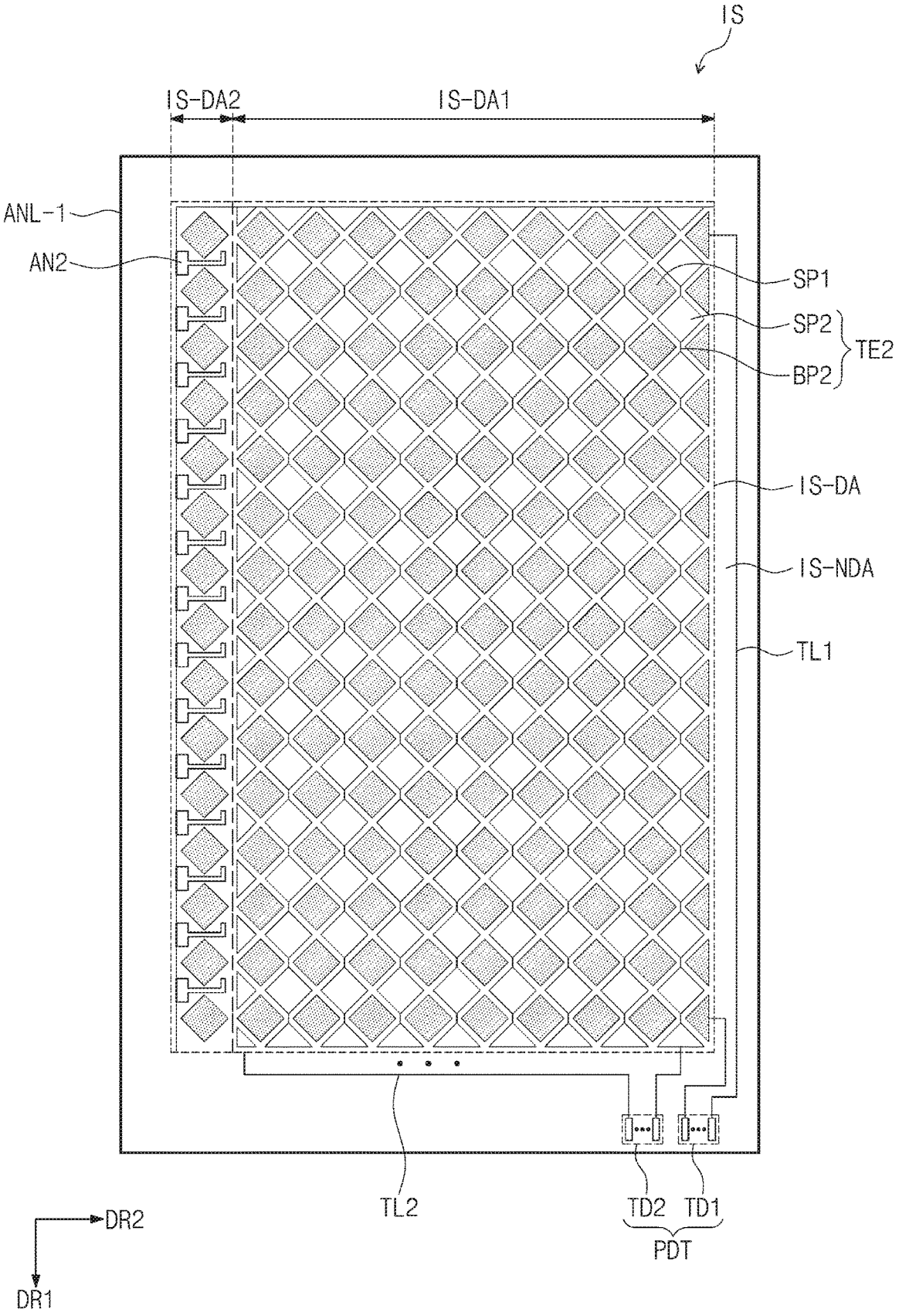
FIG. 15 is a plan view showing an input sensor and an antenna according to an embodiment of the present disclosure.

FIG. 15 is a plan view showing an input sensor and an antenna according to an embodiment of the present disclosure.

In FIG. 15, a second area IS-DA2 of the input sensor IS may be defined as an area adjacent to a non-display area IS-NDA defined at opposite sides of the input sensor IS in the second direction DR2 in the display area IS-DA. In an embodiment, the antenna AN may be disposed in the second area IS-DA2. A plurality of second sub-antennas AN2 may be disposed in the second area IS-DA2 and may be arranged in the first direction DR1. In FIG. 15, the second area IS-DA2 is defined at one side in the second direction DR2, however, the second area IS-DA2 may be defined at the other side in the second direction DR2 or may be defined at both sides in the second direction DR2.

Accordingly, the antenna AN according to the embodiment of the present disclosure may be disposed at an area of an edge of the display area IS-DA. The antenna AN may be stacked with the input sensor IS of the electronic device ED. The antenna AN may be disposed in place of some sensing patterns SP1 or SP2 disposed in an edge of the input sensor IS. The antenna AN according to the embodiment of the present disclosure may be stacked with the input sensor IS in the edge of the display area IS-DA. Thus, a volume of the electronic device ED may be reduced, and a manufacturing process of the electronic device ED may be simplified.

Figure 16A:
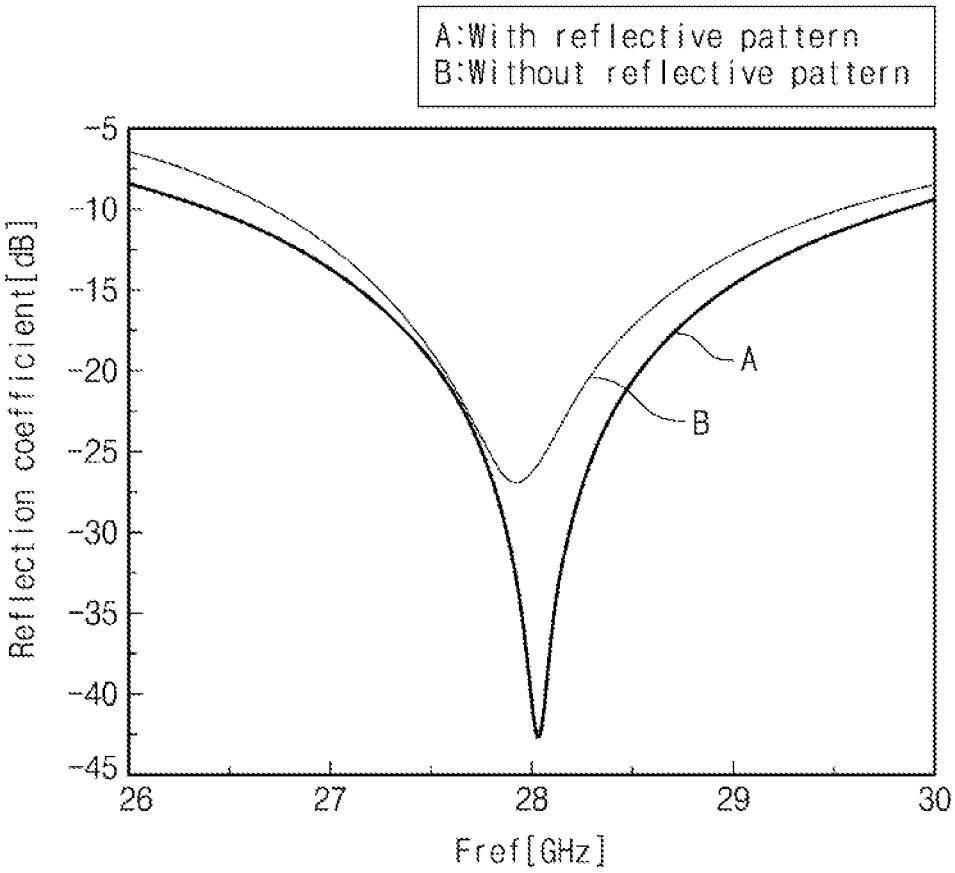
FIGS. 16A and 16B are graphs showing effects on a radiation efficiency depending on presence or absence of a reflective pattern according to an embodiment of the present disclosure.
Figure 16B:
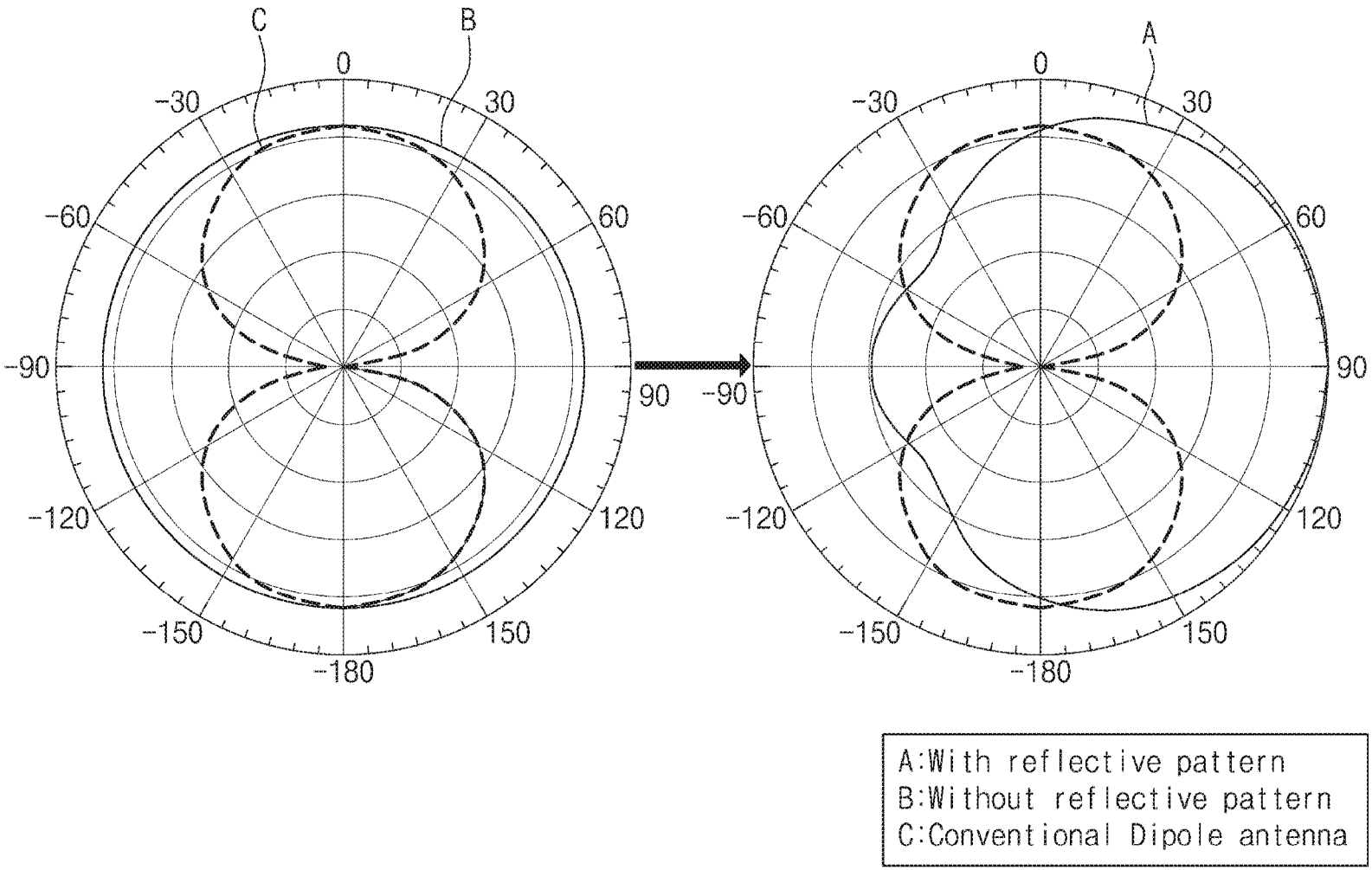

FIGS. 16A and 16B are graphs showing effects on a radiation efficiency depending on presence or absence of the reflective pattern according to an embodiment of the present disclosure. FIG. 16A is a graph showing a variation in reflection coefficient of an antenna according to an embodiment, and FIG. 16B is a graph showing a variation in radiation pattern of an antenna according to an embodiment.

In FIG. 16A, "A" shows the reflection coefficient of the antenna AN that includes the reflective pattern RFT (refer to FIG. 12) according to the embodiment of the present disclosure, and "B" shows the reflection coefficient of the antenna AN that does not include the reflective pattern RFT according to the embodiment of the present disclosure. In particular, FIG. 16A shows the reflection coefficient of the antenna AN at a frequency of about 28 GHz corresponding to a 5G protocol frequency. The reflection coefficient may indicate a signal transmission capability of the antenna AN. As an absolute value of the reflection coefficient increases, less signal energy is internally reflected and a radiation efficiency of the antenna AN is higher, whereby the signal transmission ability is improved. In the present embodiment, the reflection coefficient shown by the "A" may be about −42.5 dB, and the reflection coefficient shown by "B" may be about −25 dB. That is, the antenna AN that includes the reflective pattern RFT may have the reflection coefficient lower than that of the antenna AN that does not include the reflective pattern RFT and may have the radiation efficiency higher than that of the antenna AN that does not include the reflective pattern RFT.

Referring to FIG. 16B, "A" shows the radiation pattern of the antenna AN (refer to FIG. 12) that includes the reflective pattern RFT according to the embodiment of the present disclosure, and "B" shows the antenna AN (refer to FIG. 6A) that does not include the reflective pattern RFT according to another embodiment of the present disclosure. "C" shows a radiation pattern of a dipole antenna in a vertical plane. Since the antenna AN according to the present disclosure includes the first sub-antenna AN1 and the second sub-antenna AN2 respectively provided on lower and upper portions of the base substrate (insulating layer), the antenna AN according to the present disclosure may have a wider radiation pattern than that of a conventional dipole antenna C. In FIG. 16B, a direction from zero (0) to −180 may correspond to a vertical plane, the direction of zero (0) may indicate a display surface ED-IS direction of the electronic device ED, and the direction of −180 may indicate a rear surface direction of the electronic device ED. A direction from −90 to 90 may correspond to a horizontal plane and may indicate opposite side surface directions of the electronic device ED. In FIG. 16B, it is observed that "A" has a directivity of the antenna, which is greater than that of "B" in the horizontal plane. Since "A" has the directivity of the antenna that increases toward one side in the horizontal direction, the gain of the antenna may increase compared with "B". For example, the gain of the antenna AN of "A" may be about 4.8 dBi, and the gain of the antenna AN of "B" may be about 0.7 dBi. That is, the reflective pattern RFT may increase the directivity in the horizontal plane of the antenna AN of the present disclosure, and as a configuration of the electronic device ED, the reflective pattern RFT may enable an end-fire radiation rather than the display surface ED-IN direction in the vertical direction of the electronic device ED. Since the antenna AN according to the embodiment of the present disclosure may enable the end-fire radiation, an interference with an antenna signal by a user's body may be reduced when a user uses a mobile phone. Thus, the antenna efficiency may be improved.

In other embodiments, aspects of the inventive concept in which a dipole antenna is formed in multiple layers as described above, may also be applied to electronic devices without displays, or to display devices in which antennas are embedded outside the display area.

Although embodiments of the present disclosure have been described, it is understood that the present disclosure should not be limited to these embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims and their equivalents.

What is claimed is:

1. An electronic device comprising:

a display panel comprising a display area and a non-display area adjacent to the display area, the display area comprising a first area and a second area between the first area and one side of the non-display area;

an input sensor disposed on the display panel and comprising a plurality of bridge elements and a plurality of sensing patterns connected to the plurality of bridge elements; and an antenna disposed on a same layer as the input sensor and overlapping the second area, the antenna comprising:

a first sub-antenna disposed on a same layer as the bridge elements and comprising a first portion extending in a first direction and a second portion extending from one end of the first portion in a second direction crossing the first direction; and a second sub-antenna disposed on a same layer as the sensing patterns and comprising a third portion overlapping the first portion and a fourth portion extending from one end of the third portion in a direction opposite to the second direction.

2. The electronic device of claim 1, wherein the first portion, the second portion, the third portion and the fourth portion together form a symmetrical structure.

3. The electronic device of claim 1, wherein the first sub-antenna or the second sub-antenna further comprises a ground portion, and the ground portion is connected to the first portion or the third portion.

4. The electronic device of claim 3, wherein the ground portion extends to the non-display area.

5. The electronic device of claim 1, wherein the input sensor and the antenna further comprise a first insulating layer and a second insulating layer disposed on the first insulating layer, the first sub-antenna is disposed on the first insulating layer, and the second sub-antenna is disposed on the second insulating layer.

6. The electronic device of claim 1, wherein the first sub-antenna and the second sub-antenna have different electrical polarities from each other.

7. The electronic device of claim 1, wherein the first sub-antenna and the second sub-antenna each have a mesh structure.

8. The electronic device of claim 1, wherein the first portion has an area that is equal to an area of the third portion, and the second portion has an area that is equal to an area of the fourth portion.

9. The electronic device of claim 1, wherein the first portion of the first sub-antenna is disposed closer to the non-display area than is the second portion.

10. The electronic device of claim 5, wherein the sensing patterns comprise a plurality of first sensing patterns arranged and connected in rows oriented in the second direction, and a plurality of second sensing patterns arranged and connected in columns oriented in the first direction, and the bridge elements comprise a plurality of first bridge elements each connecting a pair of the first sensing patterns adjacent to each other in the same row among the first sensing patterns, and a plurality of second bridge elements connecting a pair of the second sensing patterns adjacent to each other in the same column among the second sensing patterns.

11. The electronic device of claim 10, wherein the first sensing patterns, the second sensing patterns, and the second bridge elements are disposed on the second insulating layer, and the first bridge elements are disposed on the first insulating layer.

12. The electronic device of claim 11, wherein the second sub-antenna is disposed between the pair of the first sensing patterns.

13. The electronic device of claim 1, wherein the display panel comprises a base surface defined therein and comprising a thin film encapsulation layer, and the input sensor and the antenna are disposed directly on the base surface.

14. The electronic device of claim 1, wherein the antenna further comprises at least one reflective pattern connected to at least one of the first sub-antenna and the second sub-antenna.

15. The electronic device of claim 14, wherein the first sub-antenna or the second sub-antenna further comprises a ground portion connected to the first portion or the third portion, respectively, and the at least one reflective pattern extends in the second direction from at least one side of the ground portion.

16. An electronic device comprising:

a display panel comprising a display area and a non-display area adjacent to the display area, the display area comprising a first area and a second area between the first area and one side of the non-display area;

an input sensor disposed on the display panel and comprising a plurality of sensing patterns;

a first antenna layer disposed on a same layer as the input sensor and overlapping the second area; and a second antenna layer disposed on the first antenna layer, wherein a first sub-antenna is disposed on the first antenna layer and extends partially in a first direction and partially in a second direction crossing the first direction, a second sub-antenna is disposed on the second antenna layer and extends partially in the first direction and partially in a direction opposite the second direction, and the first sub-antenna and the second sub-antenna have different electrical polarities.

17. The electronic device of claim 16, wherein the input sensor comprises a plurality of bridge elements and the sensing patterns connected to the plurality of bridge elements, the first antenna layer and the sensing patterns are disposed on a same layer, and the second antenna layer is disposed on a layer different from a layer on which the input sensor is disposed.

18. The electronic device of claim 17, wherein the sensing patterns comprise:

a plurality of first sensing patterns arranged in the second direction; and a plurality of second sensing patterns arranged in the second direction.

19. The electronic device of claim 18, wherein the second sub-antenna is provided in plural, the second sub-antennas are arranged in the first direction, and each of the second sub-antennas is disposed between a pair of adjacent first sensing patterns.

20. The electronic device of claim 16, further comprising an insulating layer disposed between the first antenna layer and the second antenna layer, wherein the insulating layer comprises an insulating material having a predetermined dielectric constant.

21. The electronic device of claim 16, wherein the first sub-antenna and the second sub-antenna each have a mesh structure.

22. The electronic device of claim 16, wherein one sub-antenna of the first sub-antenna and the second sub-antenna comprises:

a ground portion; and at least one reflective pattern extending in the second direction from at least one side of the ground portion.

23. An electronic device comprising:

at least first and second insulating layers, the first insulating layer being disposed on the second insulating layer;

a first sub-antenna disposed within the first insulating layer; and a second sub-antenna disposed within the second insulating layer;

wherein the first sub-antenna is a first arm of a dipole, the first arm having a first stem portion and a folded portion perpendicular to the first stem portion and extending from the first stem portion in a first direction, and the second sub-antenna is a second arm of the dipole, the second arm having a second stem portion parallel to the first stem portion and having a folded portion perpendicular to the second stem portion and extending in a direction opposite the first direction.

* * * * *